US006336446B1

(12) United States Patent
Isobe et al.

(10) Patent No.: US 6,336,446 B1
(45) Date of Patent: Jan. 8, 2002

(54) EVAPORATED FUEL TREATMENT APPARATUS FOR INTERNAL COMBUSTION ENGINE

(75) Inventors: Takashi Isobe; Takashi Yamaguchi, both of Wako; Satoshi Kiso, Tochigi, all of (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/716,439

(22) Filed: Nov. 21, 2000

(30) Foreign Application Priority Data

Dec. 20, 1999 (JP) ..... 11-360565

(51) Int. Cl.[7] ..... F02M 37/04
(52) U.S. Cl. ..... 123/520; 123/198 D
(58) Field of Search ..... 123/520, 531, 123/518, 519, 198 D, 516

(56) References Cited

U.S. PATENT DOCUMENTS 5,477,842 A * 12/1995 Maruyama et al. ..... 123/690
5,614,665 A * 3/1997 Curran et al. ..... 73/118.1
5,669,362 A * 9/1997 Shinohara et al. ..... 123/520
5,685,279 A * 11/1997 Blomquist et al. ..... 123/520
5,715,799 A * 2/1998 Blomquist et al. ..... 123/520

FOREIGN PATENT DOCUMENTS

JP A-9-291856 11/1997
JP A-10-37815 2/1998

* cited by examiner

*Primary Examiner*—Carl S. Miller
(74) *Attorney, Agent, or Firm*—Arent Fox Kintner Plotkin & Kahn, PLLC

(57) ABSTRACT

The present invention enables a large leak to be accurately detected by providing an evaporated fuel treatment apparatus for an internal combustion engine. The apparatus comprises the evaporated fuel discharge prevention system including a fuel tank, a canister having an opening to the atmosphere, a passage allowing the fuel tank to communicate with the canister, a purging passage allowing the canister to communicate with the intake manifold of the engine. The apparatus also comprises a pressure sensor for detecting the pressure of the evaporated fuel discharge prevention system, and a controller coupled to the pressure sensor for judging the presence of a first leak in the evaporated fuel discharge prevention system if a change in the pressure from the pressure sensor is small. The controller further checks a change in the pressure from said pressure sensor when closing said system after placing said system under negative pressure. The controller judges the presence of a large leak if the first leak is judged and the pressure increases instantaneously upon closing said system.

20 Claims, 20 Drawing Sheets

EVAPORATED FUEL TREATMENT APPARATUS FOR INTERNAL COMBUSTION ENGINE

FIELD OF THE INVENTION

The present invention relates to trouble diagnosis for an evaporated fuel treatment apparatus for an internal combustion engine which emits an evaporated fuel generated in a fuel tank to an intake system of the internal combustion engine, and specifically, to an evaporated fuel treatment apparatus for an internal combustion engine which detects leakage from the fuel tank and turns on a warning lamp, the apparatus turning off the warning lamp if the leakage is caused by a large leakage and if no leakage is subsequently detected.

BACKGROUND OF THE INVENTION

Japanese Patent Application Kokai No. Hei 10-37815 presents methods for judging the presence of leakage from a fuel tank. One of the methods comprises detecting the pressure of the fuel tank a number of times and judging the presence of leakage if the detected values concentrate in neighborhoods of the atmospheric pressure while judging the absence of leakage if the detected values deviate significantly from the atmospheric pressure in a positive or negative direction. Thus, whether there is leakage or not can be easily judged without reducing the pressure of the fuel tank.

Another method for judging whether there is leakage from a fuel tank comprises reducing the pressure of the fuel tank down to a predetermined value, then closing the fuel tank. The absence of leakage is judged if the variation of the pressure of the fuel tank measured after closing the fuel tank is smaller than a predetermined value, while the presence of leakage is judged if the variation is larger than the predetermined value (this judgment process is called a leak checking process). In this case, in order to exclude the effects of vapors, the variation of the pressure caused by vapors must be considered as a correction value. This method enables the detection of leakage even from a very small hole with a diameter of 0.5 mm in a tank.

On the other hand, a large hole (i.e. a large leak) in the fuel tank is chiefly generated by a user's failure to close a filler cap of a fuel tank and should preferably be handled separately from the above-mentioned detection for very small hole before issuing a warning to the user. Japanese Patent Application Kokai No. Hei 9-291856 describes a method for judging abnormality or malfunctioning of the fuel tank, wherein whether there is a large hole is judged. This method comprises reducing the pressure of the fuel tank down to a predetermined value, and calculating the variation of the pressure to check for leakage. The presence of a large hole is judged if the difference between the pressure of the fuel tank measured at the end of the pressure reducing process and the pressure measured within a predetermined period of time after the start of the leak checking process is larger than a predetermined value.

The above-mentioned method may judge the presence of a large hole even when the leakage is actually small or no leakage is actually occurring, for a combined reason associated with the amount of fuel fed and the variation of the flow rate of a purge control valve. In addition, even if the presence of a large hole is judged by a user's error such as the user's failure to close the filler cap, a MIL (warning lamp) is lit. When the user notices his or her failure and closes the filler cap, the MIL should be turned off while the above mentioned prior art lacks means for doing so.

SUMMARY OF THE INVENTION

It is therefore an object of the present invention to provide an evaporated fuel treatment apparatus that can accurately detect a large hole.

It is another object of the present invention to provide an evaporated fuel treatment apparatus that can turn off a warning light in a timely manner, if the detection of a large hole terminates while the warning lamp is lit since the large hole was detected.

Accordingly, according to an aspect of the present invention, an evaporated fuel treatment apparatus for an internal combustion engine is provided. The apparatus comprises an evaporated fuel discharge prevention system including a fuel tank, a canister having an opening to the atmosphere, a passage allowing the fuel tank to communicate with the canister, and a purging passage allowing the canister to communicate with the intake manifold of the engine. The apparatus also comprises a pressure sensor for detecting the pressure of the evaporated fuel discharge prevention system.

The apparatus further comprises a controller coupled to the pressure sensor for judging the presence of a first leak in the evaporated fuel discharge prevention system if a change in the pressure from the pressure sensor is small. The controller further checks a change in the pressure from said pressure sensor when said system is closed after placing the system under a negative pressure. The controller judges the presence of a large leak if the first leak is judged and the pressure increases instantaneously upon closing said system.

According to another aspect of the invention, the apparatus further comprises a warning lamp lit by the controller when the first leak is judged. The controller turns off the warning lamp when the presence of the large leak was detected in a previous judgment cycle, but any leak, including the first leak and the large leak, is not detected in the current judgment cycle.

According to further aspect of the invention, the presence of the first leak is judged if the pressure concentrates in neighborhoods of the atmospheric pressure.

According to another aspect of the invention, the presence of the large leak is judged if the difference between the pressure as detected when the system is placed under a negative pressure and the pressure as detected immediately after the evaporated fuel discharge prevention system is closed is greater than a predetermined value.

Furthermore, requirements for judging the presence of the large leak may include one or more of the following condition:

i) the difference, between the pressure as detected when the evaporated fuel discharge prevention system is opened to the atmosphere and the pressure as detected when the bypass valve is closed after said opening to the atmosphere, is smaller than a predetermined value, ii) the difference, between the pressure as detected when the evaporated fuel discharge prevention system is opened to the atmosphere and the pressure as detected when the system is closed after placing the system under a negative pressure, is smaller than a predetermined value, iii) the difference, between the pressure as detected immediately after the evaporated fuel discharge prevention system is closed and the pressure as detected a predetermined period of time after the system is closed, is smaller than a predetermined value, iv) a period required for placing the evaporated fuel discharge system under a predetermined negative pressure is longer than a predetermined period.

DETAILED DESCRIPTION OF THE PREFERRED EMBODIMENTS

Figure 1:
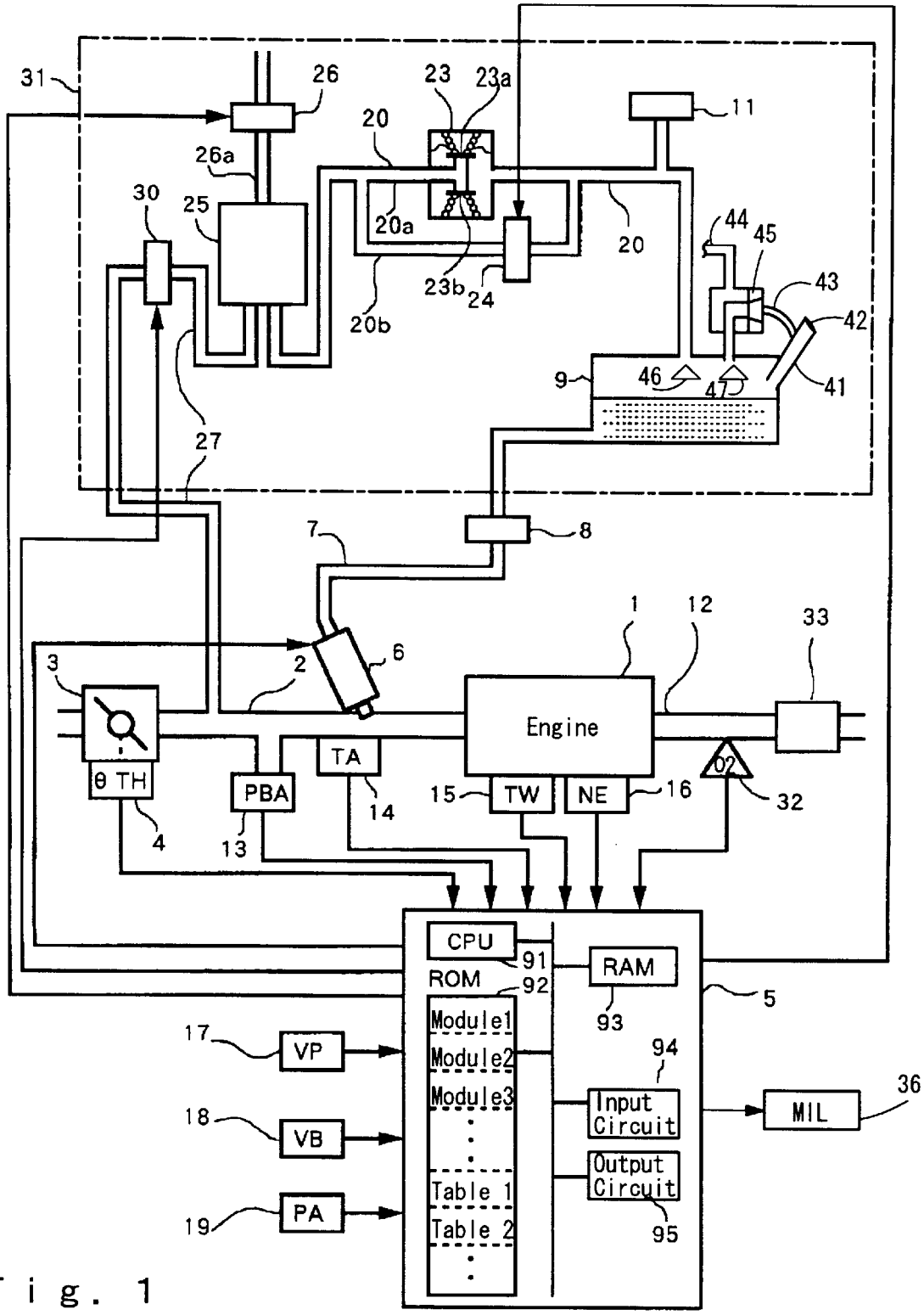
FIG. 1 is a diagram illustrating an evaporated fuel treatment apparatus of the present invention.

The disclosed embodiments of the present invention will be described with reference to the attached drawings. FIG. 1 is an overall structural diagram of an evaporated fuel treatment apparatus for an internal combustion engine constructed according to a preferred embodiment of the present invention. This apparatus includes an internal combustion engine (hereafter referred to as the engine) 1, an evaporated fuel discharge prevention device 31 and an electronic control unit (hereafter referred to as the ECU) 5.

The ECU 5 constitutes a controller and includes a CPU 91, which performs operations in order to control various parts of the engine 1, a read-only memory (ROM) 92, which stores various types of data and programs that are used to control various parts of the engine, a random-access memory (RAM) 93, which provides a working area for operations by the CPU 91 and which temporarily stores data sent from various parts of the engine and control signals that are to be sent out to various parts of the engine, an input circuit 94, which receives data sent from various parts of the engine, and an output circuit 95, which sends out control signals to various parts of the engine.

In FIG. 1, the programs are indicated as module 1, module 2, module 3, etc. For example, the program that detects the presence or absence of leakage in the present invention is contained in modules 3, 4 and 5. Furthermore, the various types of data used in the above-mentioned operations are stored in the ROM 92 in the form of table 1, table 2, etc. The ROM 92 may be a re-writable ROM such as an EEPROM. In such a case, the results obtained from the operations of the ECU 5 in a driving cycle are stored in the in the ROM and can be utilized in subsequent driving cycles. Furthermore, considerable quantities of flags set in various processes can be recorded in the EEPROM, and utilized in trouble diagnosis.

The engine 1 is, for example, an engine equipped with four cylinders, and an intake manifold 2 is connected to this engine. A throttle valve 3 is provided on the upstream side of the intake manifold 2, and a throttle valve opening sensor (θTH) 4, which is linked to the throttle valve 3, outputs an electrical signal that corresponds to the amount of opening of the throttle valve 3 and sends this electrical signal to the ECU.

A fuel injection valve 6 is provided for each cylinder at an intermediate point in the intake manifold 2 between the engine 1 and the throttle valve 3. The opening time of the injection valve 6 is controlled by control signals from the ECU 5. A fuel supply line 7 connects the fuel injection valve 6 and the fuel tank 9, and a fuel pump 8 provided at an intermediate point in this fuel supply line 7 supplies fuel from the fuel tank 9 to the fuel injection valve 6. A regulator (not shown in the figures) is provided between the pump 8 and the fuel injection valves 6. This regulator acts to maintain the differential pressure between the pressure of the air taken in from the intake manifold 2 and the pressure of the fuel supplied via the fuel supply line 7 at a constant value. In cases where the pressure of the fuel is too high, the excess fuel is returned to the fuel tank 9 via a return line (not shown in the figures). Thus, the air taken in via the throttle valve 3 passes through the intake manifold 2. The air is then mixed with the fuel injected from the fuel injection valve 6 and is supplied to each of the cylinders of the engine 1.

An intake manifold pressure (PBA) sensor 13 and an intake air temperature (TA) sensor 14 are mounted in the intake manifold 2 on the downstream side of the throttle valve 3. These sensors convert the intake manifold pressure and intake air temperature into electrical signals and send these signals to the ECU 5.

An engine water temperature (TW) sensor 15 is attached to the cylinder peripheral wall (filled with cooling water) of the cylinder block of the engine 1. The sensor 15 detects the temperature of the engine cooling water, converts this temperature into an electrical signal, and sends the result to the ECU 5. An engine rpm (NE) sensor 16 is attached to the periphery of the camshaft or the periphery of the crankshaft of the engine 1. The sensor 16 outputs a signal pulse (TDC signal pulse) at a predetermined crank angle position with every 180-degree rotation of the crankshaft of the engine 1 and sends this signal to the ECU 5.

The engine 1 has an exhaust manifold 12, and exhaust gases are discharged via a ternary catalyst 33 constituting an exhaust gas cleansing device, which is provided at an intermediate point in the exhaust manifold 12. An O2 sensor 32 constitutes an exhaust gas concentration sensor; this sensor 32, which is mounted at an intermediate point in the exhaust manifold 12 detects the oxygen concentration in the exhaust gas and sends a signal corresponding to the detected value to the ECU 5.

A vehicle speed (VP) sensor 17, a battery voltage (VB) sensor 18 and an atmospheric pressure (PA) sensor 19 are connected to the ECU 5. These sensors respectively detect the running speed of the vehicle, the battery voltage, and the atmospheric pressure and send these values to the ECU 5.

The input signals from the various types of sensors are sent to the input circuit 94. The input circuit 94 shapes the input signal waveforms, corrects the voltage levels to predetermined levels, and converts analog signal values into digital signal values. The CPU 91 processes the resulting digital signals, performs operations in accordance with the programs stored in the ROM 92, and creates control signals that are sent out to actuators in various parts of the vehicle. These control signals are sent to the output circuit 95, and the output circuit 95 sends the control signals to actuators such as the fuel injection valve 6, bypass valve 24, vent shut valve 26, and purge control valve 30.

The evaporated fuel discharge prevention system 31 will be described in conjunction with FIG. 1. The discharge prevention system 31 includes a fuel tank 9, a charging passage 20, a canister 25, a purging passage 27, and several control valves. The system 31 controls the discharge of evaporated fuel from the fuel tank 9. The discharge prevention system 31 may be conveniently viewed as being divided into two parts, with the bypass valve 24 in the charging passage 20 as the boundary between the two parts. The side including the fuel tank 9 is referred to as the tank system, while the side including the canister 25 is referred to as the canister system.

The fuel tank 9 is connected to the canister 25 via the charging passage 20, and the system is thus arranged so that evaporated fuel from the fuel tank 9 can move to the canister 25. The charging passage 20 has a first branch 20*a* and a second branch 20*b*, which are installed inside the engine space. An internal pressure sensor 11 is attached to the fuel tank side of the charging passage 20 for detecting the differential pressure between the internal pressure of the charging passage 20 and atmospheric pressure. In a normal state, the pressure inside the charging passage 20 is more or less equal to the pressure inside the fuel tank 9, and accordingly, the internal pressure detected by the internal pressure sensor 11 may be viewed as the pressure in the fuel tank 9 (hereafter referred to as the tank pressure).

A two-way valve 23 is installed in the first branch 20*a*, which includes two mechanical valves 23*a* and 23*b*. The valve 23*a* is a positive-pressure valve that opens when the tank pressure reaches a value that is approximately 2.0 kPa (kilopascals) higher than atmospheric pressure. When this valve is in an open state, evaporated fuel flows to the canister 25 and is adsorbed in the canister. The valve 23*b* is a negative-pressure valve that opens when the tank pressure is approximately 1.3 kPa to 2.0 kPa lower than the pressure in the canister side. When this valve is in an open state, the evaporated fuel adsorbed in the canister 25 returns to the fuel tank 9.

A bypass valve 24, which is a solenoid valve, is installed in the second branch 20*b*. This bypass valve 24 is ordinarily in a closed state, and the opening and closing action of this valve is controlled by control signals from the ECU 5 in performing the process of detecting the presence of leakage in the discharge prevention system 31.

The fuel tank 9 has a refuel tube 41 including a filler cap 42 and is connected to the canister 25 via a charging passage 44 (only partly shown) for refueling. The refuel charging passage 44 has a larger cross part than the charging passage 20 and supplies the canister 25 with a large amount of evaporated fuel generated during refueling. The charging passage 44 has a diaphragm valve 45 in its middle, which is connected to a neighborhood of a refuel port in the refuel tube 41 via a passage 43 so as to be opened only during refueling.

First and second float valves 46 and 47 are installed in portions of the fuel tank 9 where the charging passages 20 and 44 are opened into the tank 9. The first and second float valves 46 and 47 are closed when the fuel tank 9 becomes full or is inclined, to prevent a liquid fuel from flowing out to the charging passage 20 or 44.

The canister 25 incorporates an active carbon that adsorbs fuel vapors and has an intake port (not shown) in communication with the atmosphere via the passage 26*a*. The vent shut valve 26 comprising a solenoid valve is installed in the middle of the passage 26*a*. The vent shut valve 26 is normally open and is controllably opened and closed in response to a control signal from the ECU 5 in detecting leakage of the discharge prevention system 31 according to the present invention.

The canister 25 is connected to a downstream side of the throttle valve 3 in the intake manifold 2 via the purging passage 27. A purge control valve 30 comprising a solenoid valve is installed in the middle of the purging passage 27 so that a fuel adsorbed by the canister 25 is purged to the intake system of the engine via the purge control valve 30 as appropriate. The purge control valve 30 alters the on-off duty ratio based on the control signal from the ECU 5, to continuously control the flow rate.

A MIL 36 is a warning lamp installed on a display panel at a driver's seat. When the discharge prevention system 31 judges the presence of leakage or when the discharge prevention system 31 detects another failure, the MIL 36 is lit in response to the control signal from the ECU 5 to warn the driver that a certain failure is occurring. In addition, in response to the control signal from the ECU 5, the MIL 36 is turned off when the detected failure is judged to be an erroneous diagnosis or when the failure has been corrected.

Figure 2:
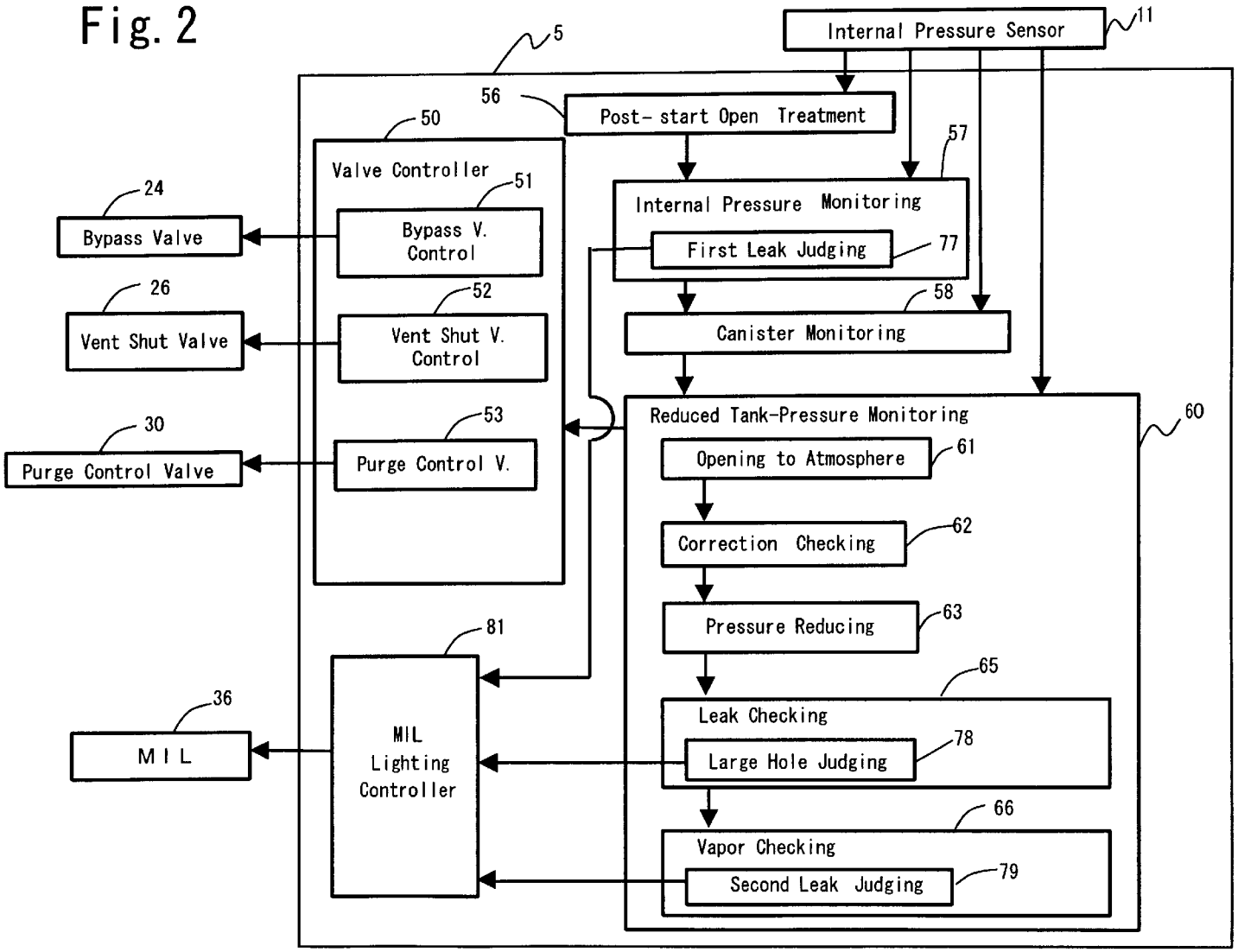
FIG. 2 is a functional block diagram of an ECU according to the present invention.

FIG. 2 shows functional blocks of the ECU 5 according to this embodiment of the present invention. These functional blocks are implemented by the hardware configuration of the ECU 5 shown in FIG. 1 and programs stored in the ROM 92. The functional blocks of the ECU 5 deliver data therebetween chiefly via the RAM 93. The ECU 5 comprises a valve controller 50, a post-start open treatment part 56, an internal pressure monitoring 57, a canister monitoring part 58, a reduced tank-pressure monitoring part 60, and a MIL lighting controller 81. The functional blocks are each explained with reference to FIGS. 3 to 7.

The valve controller 50 comprises a bypass valve controller 51 for controllably opening and closing the bypass valve 24, a vent shut valve controller 52 for controllably opening and closing the vent shut valve 26, and a purge control valve controller 53 for controlling the amount that the purge control valve 30 is opened. The valve controller 50 transmits drive signals to the corresponding valves in response to control signals from the post-start open treatment part 56, the internal pressure monitoring part 57, the canister monitoring part 58, and the reduced tank-pressure monitoring part 60.

The post-start open treatment part 56, the internal pressure monitoring part 57, the canister monitoring part 58, and the reduced tank-pressure monitoring part 60 implement a process for judging whether there is leakage in the discharge prevention system 31. During a single driving cycle (from start to stop of the engine), the process for judging whether there is leakage is carried out only once. How often this process is executed, however, may be changed as required depending on design.

Figure 3:
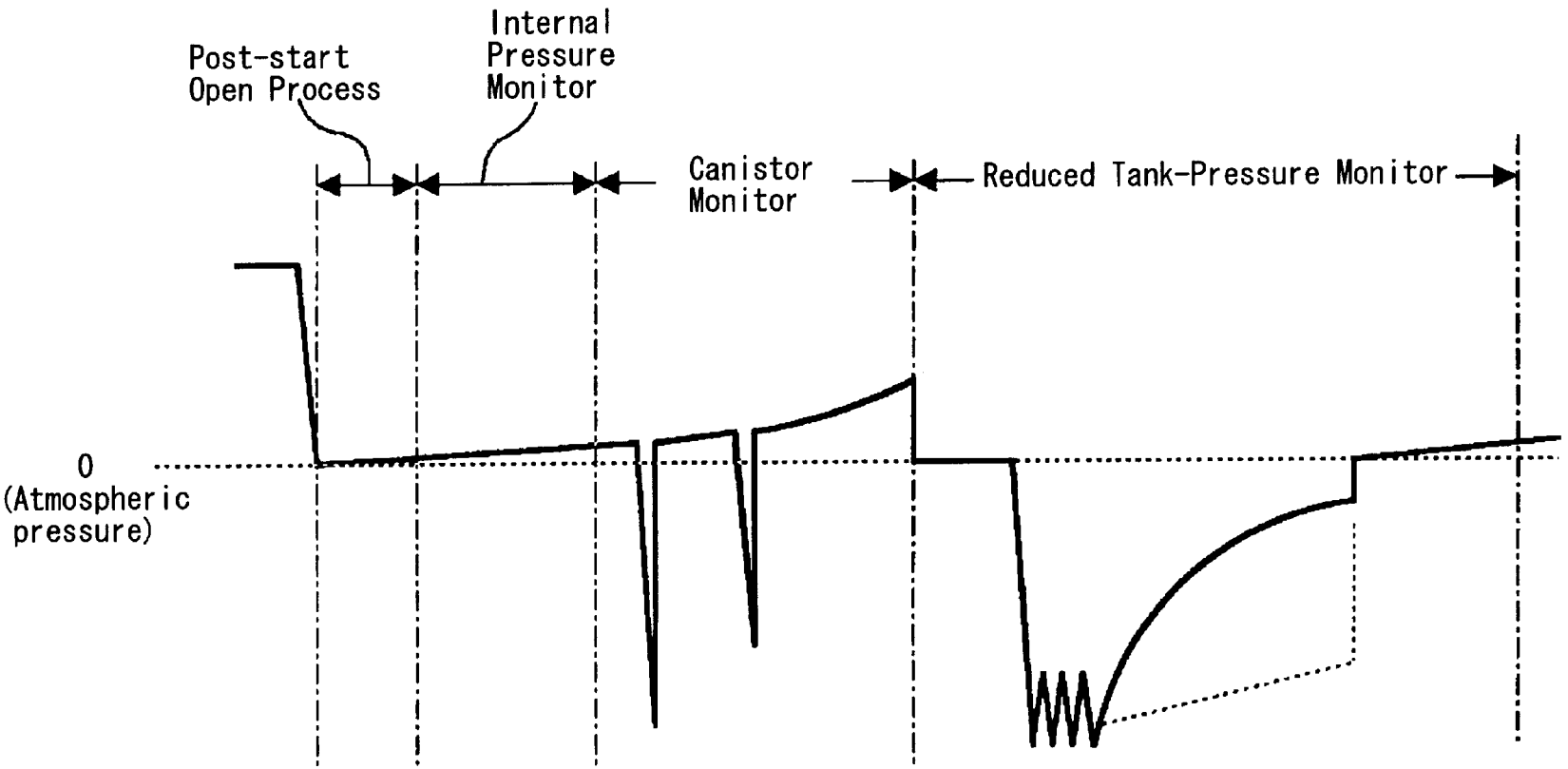
FIG. 3 is a graph showing an example of transitions of the pressure during one driving cycle wherein the evaporated fuel treatment apparatus of the present invention judges whether there is leakage.

FIG. 3 shows an example of transitions of the pressure detected by the internal pressure sensor 11 during one driving cycle. The process for judging whether there is leakage comprises four phases, that is, a post-start open process, an internal pressure monitor, a canister monitor, and a reduced tank-pressure monitor.

The post-start open process executed by the post-start open treatment part 56 comprises opening the bypass valve 24 immediately after the start of the engine to open the discharge prevention system 31 to the atmospheric pressure and judging that the tank system has no leakage, that is, the tank system is normal, if the tank pressure fluctuates from a value measured before opening the discharge prevention system 31 to the atmosphere, by a predetermined value or larger.

In the internal pressure monitoring executed by the internal pressure monitoring part 57, the tank pressure detected by the internal pressure sensor 11 is continuously checked. A first leak judging part 77 included in the internal pressure monitoring part 57 judges the presence of leakage if the detected values concentrate in neighborhoods of the atmospheric pressure, while judging the absence of leakage if the detected values deviate significantly from the atmospheric pressure in a positive or negative direction. If the presence of leakage is judged, one is set in a first leak presence flag, which is then stored in the RAM 93. In this embodiment, the internal pressure monitoring part 57 detects leakage originating from a hole of diameter 1 mm or larger.

The canister monitoring executed by the canister monitoring part 58 includes modes for opening the canister to the atmosphere, reducing the pressure of the canister, waiting for the pressure to stabilize, checking a leak of the canister, and recovering the pressure. Judgment of the presence or absence of leakage in the canister system is carried out by placing the canister 25 at a negative pressure and detecting how the negative pressure is maintained.

The reduced tank-pressure monitoring 60 monitors the reduced tank pressure. This enables detection of a small leak of the tank system, which cannot be detected by the above-mentioned post-start open treatment and internal pressure monitor. In other words, the post-start open treatment or the internal pressure monitoring can judge the presence of a hole of diameter 1 mm or larger, while the reduced tank-pressure monitoring can judge the presence of leakage through a smaller hole of diameter 0.5 mm. Therefore, when the absence of leakage is judged in the post-star open treatment or the internal pressure monitoring, the presence of a smaller hole of a diameter 0.5 mm can be judged by performing the reduce tank-pressure monitor. The reduced tank-pressure monitoring will be described with reference to FIG. 4.

Figure 4:
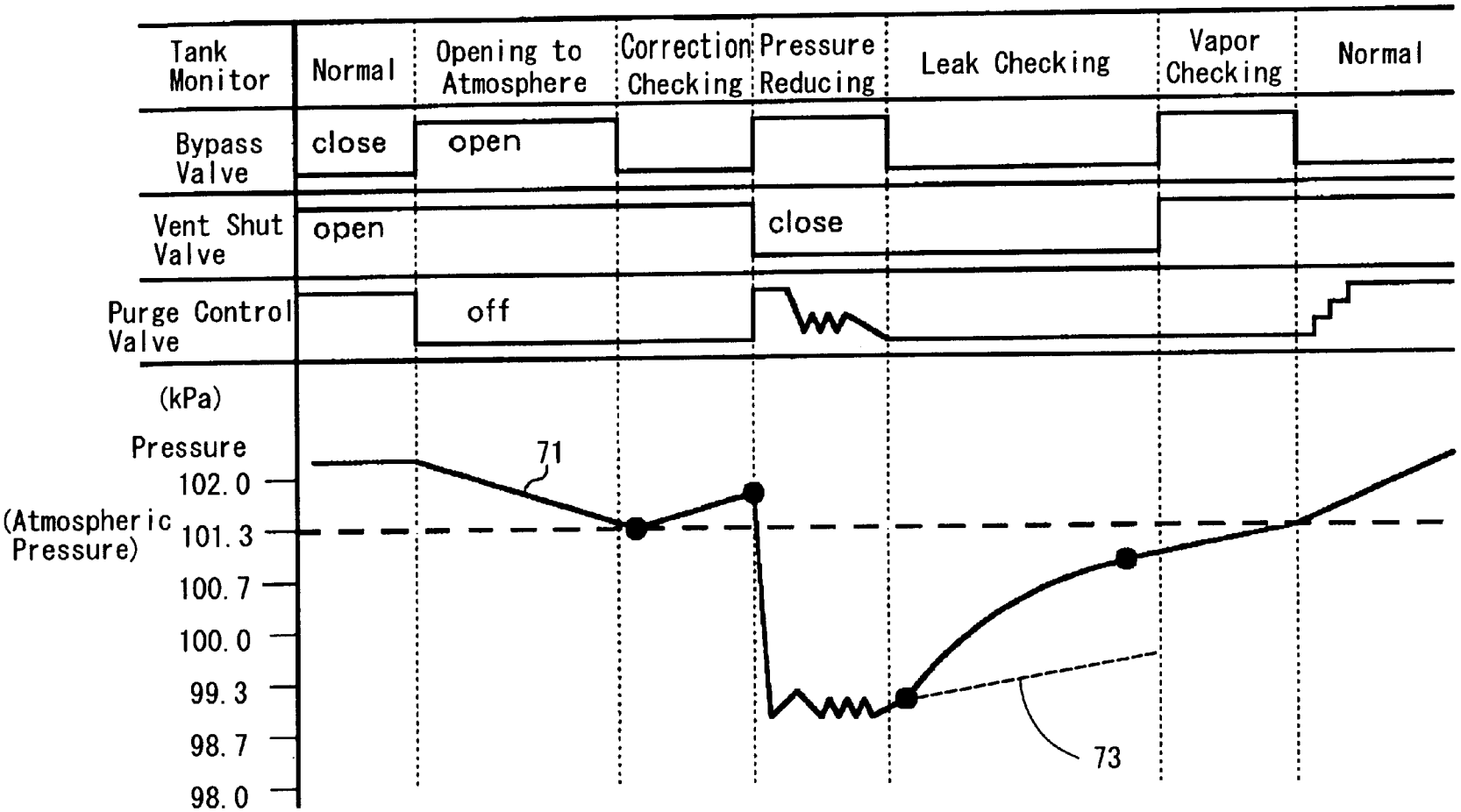
FIG. 4 is a graph showing an example of transitions of the pressure during the reduced tank-pressure monitor period in FIG. 3.

As shown in FIGS. 2 and 4, the reduced tank-pressure monitoring includes five modes executed by an opening-to-atmosphere part 61, a correction checking part 62, a pressure reducing part 63, a leak checking part 65, and a vapor checking part 66. FIG. 4 shows examples of transitions of the pressure detected by the internal pressure sensor 11; a solid line 71 indicates that there is a small leakage from the tank system, while a broken line 73 indicates that there is no leakage from the tank system.

The opening-to-atmosphere part 61 shifts the tank system to an open-to-atmosphere mode by opening the bypass valve 24 while closing the purge control valve 30. As a result, the tank pressure changes to the atmospheric pressure as shown by the solid line 71. The open-to-atmosphere mode requires, for example, 15 seconds.

The correction checking part 62 shifts the tank system to a correction checking mode by closing the bypass valve 24. Vapors are generated in the fuel tank 9, so that the tank pressure rises depending on the amount of vapors. Accordingly, the rise in pressure must be taken into account in subsequently judging whether there is leakage from the tank system. Thus, the correction checking part 62 measures a variation from the atmospheric pressure to a positive pressure per unit time, as a correction value. The correction checking mode requires, for example, 30 seconds.

The pressure reducing part 63 shifts the tank system to a pressure reducing mode by opening the bypass valve 24 while closing the vent shut valve 26. The pressure reducing part 63 stably reduces the tank pressure down to a predetermined value, for example, 99.3 kPa (about 2.0 kPa lower than the atmospheric pressure) while controlling the amount of opening of the purge control valve. The internal pressure sensor 11 is installed in the narrow charging passage 20, which changes to a negative pressure at a high speed, whereas the fuel tank 9 has a large capacity. Accordingly, even when the sensor 11 indicates a negative pressure, the fuel tank 9 is not actually at the negative pressure. Thus, in order to effectively place the pressure of the fuel tank 9 under a negative pressure, the pressure reducing part 63 carries out an open pressure-reducing process and then feedback pressure-reducing process.

Figure 5:
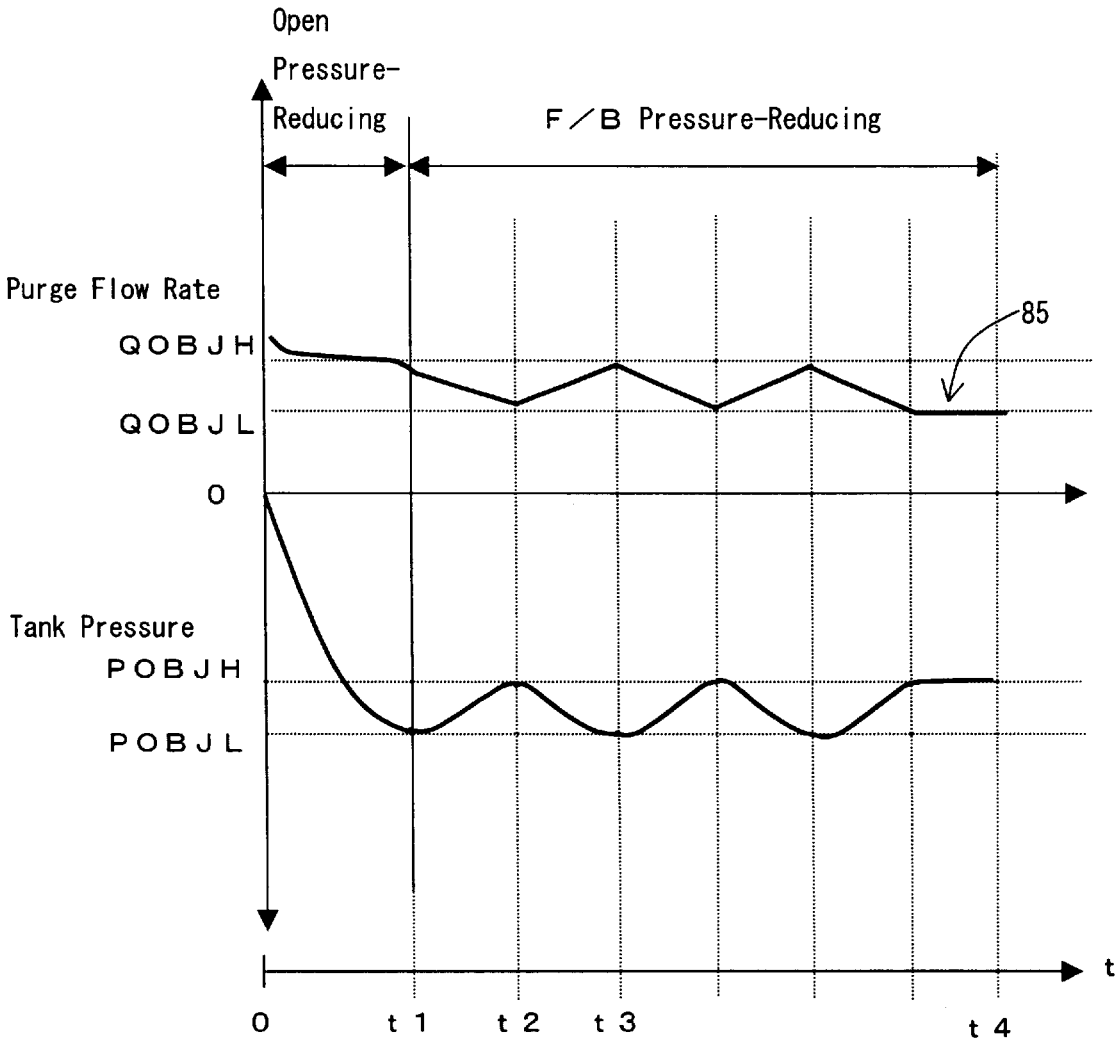
FIG. 5 is a graph showing an example of variations of the tank pressure during the pressure reducing process in FIG. 4.

The open pressure-reducing and feedback (F/B) pressure-reducing processes will be described below with reference to FIG. 5. In the open pressure-reducing process (time 0 to t1), the pressure reducing part 63 accesses an open pressure-reducing target flow rate table stored in the ROM 92 to calculate a purge flow rate depending on the current tank pressure, and then sets the purge control valve 30 at a valve travel corresponding to the purge flow rate. The vent shut valve 26 is subsequently closed while the bypass valve 24 and the purge control valve 30 are opened to reduce the pressure of the tank system. This pressure reducing process is repeated a predetermined number of times to reduce the pressure of the tank system down to a certain value.

The pressure reducing part 63 then executes the F/B pressure reducing process (t1 to t4). More particularly, a lower limit value POBJL (for example, 98.9 kPa) and an upper limit value POBJH (for example, 99.3 kPa) are predetermined in accordance with the pressure to which the tank pressure is to be reduced. When an output from the internal pressure sensor 11 reaches the lower limit value POBJL, which is initially set as a target pressure value, the target pressure value is switched to the upper limit value POBJH. Based on the current tank pressure and the target pressure value, a purge flow rate QOBJL is calculated such that the tank pressure reaches the target pressure value, and the purge control valve 30 is set at a valve travel corresponding to the calculated purge flow rate. As a result, the purge flow rate decreases while the tank pressure increases correspondingly (t1 to t2).

Then, when the output from the internal pressure sensor 11 reaches the upper limit value POBJH, the target pressure value is switched to the lower limit value POBJL, and based on the current tank pressure and the target pressure value, a purge flow rate QOBJH is calculated such that the tank pressure reaches the target pressure value, and the purge control valve 30 is set at a valve travel corresponding to the calculated purge flow rate. As a result, the purge flow rate increases while the tank pressure decreases correspondingly (t2 to t3).

In this manner, after repeating pressure recovery and pressure reduction alternately while reducing and increasing the purge flow rate between the upper limit value and lower limit value, the purge flow rate remains at the lower limit value QOBJL (as indicated by reference numeral 85). That is, even when the target pressure value is switched to the lower limit value POBJL and the purge flow rate is increased, the tank pressure will not decrease down to the lower limit value POBJL. This means that the tank pressure has reached a stable point in a negative pressure state between the upper limit value and the lower limit value where the pressure of the fuel tank is not changed even if the purge flow rate is changed. When this state is entered, the F/B pressure-reducing process is completed. This is also applicable when the purge flow rate remains at the upper limit value and the tank pressure will not increase up to the upper limit value even if the purge flow rate is reduced. The F/B pressure-reducing process substantially eliminates the difference between a pressure shown by the internal pressure sensor 11 and the actual tank pressure. The pressure reducing mode requires, for example, 30 to 40 seconds.

Referring back to FIG. 4 again, the leak checking part 65 closes all the valves 24, 26, and 30 and shifts the tank system to a leak checking mode. If there is no leakage from the tank system, the negative pressure is substantially maintained and the amount of pressure recovered (due to the effect of vapors) is small as shown by the broken line 73. If there is leakage from the tank system, the amount of pressure recovered is relatively large as shown by the solid line 71. Since a very small hole of diameter 0.5 mm must be detected, the leak checking mode requires, for example, 30 seconds.

The vapor checking part 66 opens the bypass valve 24 and the vent shut valve 26 and shifts the tank system to a vapor checking mode (i.e. a pressure recovering mode) to return the tank system to the atmospheric pressure. The vapor checking part 66 comprises a second leak judging part 79. When the tank pressure changes from a positive pressure to the atmospheric pressure in the vapor checking mode, which means that the pressure have changed to a positive pressure in the leak checking mode, the variation of the pressure cannot be accurately calculated. Accordingly, the second leak judging part 79 prohibits judgment of whether there is leakage. On the contrary, if the tank pressure changes from a negative pressure to the atmospheric pressure in the vapor checking mode, a correction value determined by the correction checking part 62 is multiplied by a coefficient and the result is subtracted from the amount of pressure shift per unit time during the leak checking mode to judge whether there is leakage. If the presence of leakage is judged, the second leak judging part 79 sets one in a second leak presence flag, which is then stored in the RAM 93. This judgment of whether there is leakage enables the detection of leakage from a very small hole of diameter 0.5 mm. The vapor checking mode requires, for example, 3 seconds.

The leak checking part 65 comprises a large hole judging part 78 to check whether the tank system has a large hole (i.e. a large leak). Parameters used by the large hole judging part 78 to judge whether there is a large hole will be discussed with reference to FIG. 6.

Figure 6:
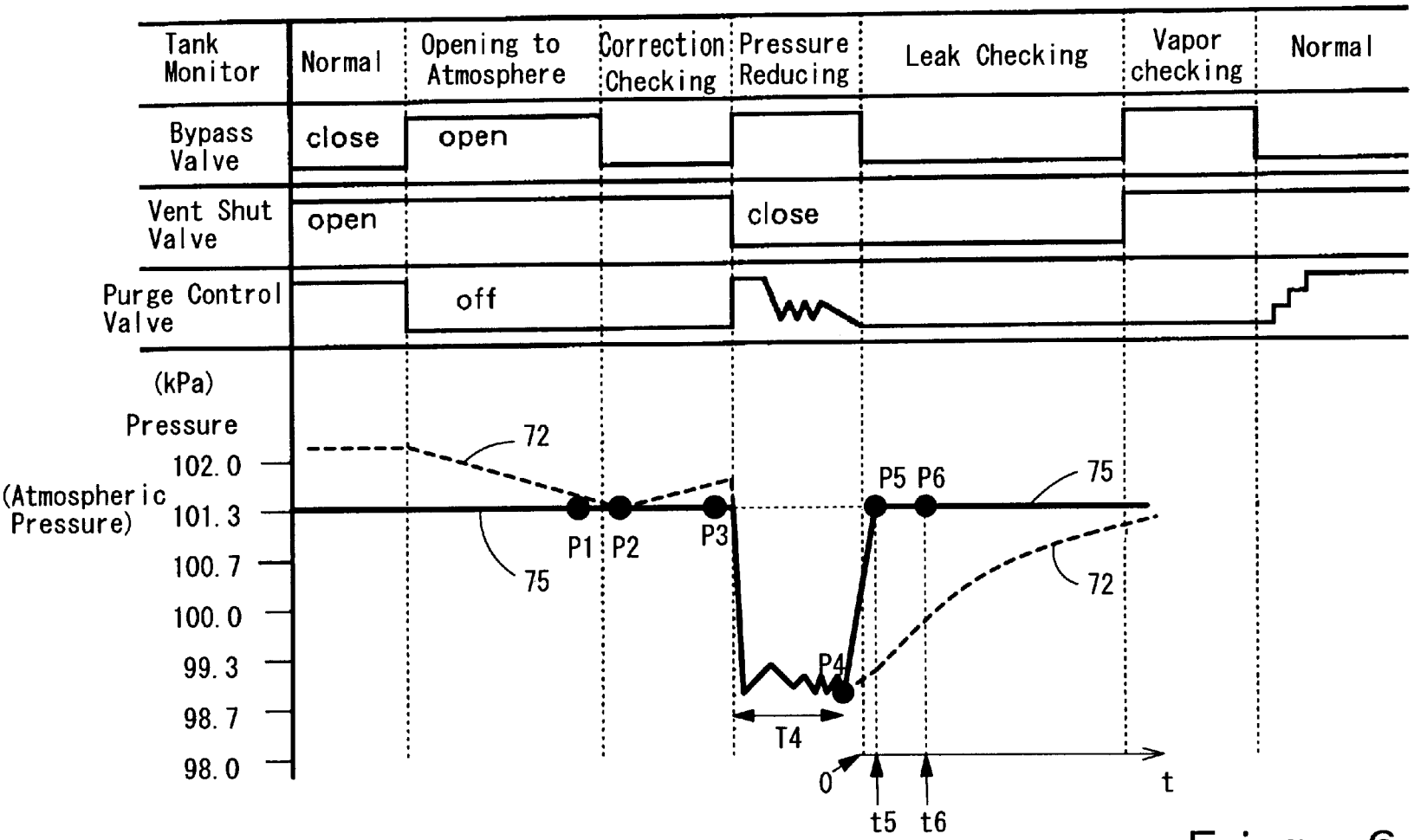
FIG. 6 is a graph showing an example of transitions of the pressure during the reduced tank-pressure monitor period when a fuel tank has a large hole.

A solid line 75 in FIG. 6 shows transitions of the tank pressure detected by the internal pressure sensor 11 during the reduced tank-pressure monitoring when the fuel tank 9 has a large hole. A dotted line 72 corresponds to the solid line 71 in FIG. 4, and indicates transitions of the tank pressure observed when there is leakage from a very small hole in the fuel tank 9. If the fuel tank 9 has a large hole, the internal pressure of the fuel tank already changed to the atmospheric pressure before the tank system shifting to the open-to-atmosphere mode. Furthermore, the tank pressure remains at the atmospheric pressure even after the bypass valve has been closed. Consequently, the tank pressure remains at the atmospheric pressure during the open-to-atmosphere mode and during the correction checking mode. The opening-to-atmosphere part 61 stores the tank pressure measured at the end of the open-to-atmosphere mode, in the RAM 93 as P1. The correction checking part 62 stores the tank pressures measured at the start and end of the correction checking mode, in the RAM 93 as P2 and P3, respectively.

When the pressure reducing part 63 shifts the tank system to the pressure reducing mode to reduce the pressure of the tank system, the internal pressure sensor 11 shows a value of a negative pressure despite the presence of a large hole because the internal pressure sensor 11 is located in the narrow charging passage 20 as described above. When the leak checking part 65 closes the purge control valve 30 and the bypass valve 24 to shift the tank system to the leak checking mode, since the actual internal pressure of the fuel tank 9 is the atmospheric pressure, the pressure of the entire tank system attempts to recover its balance, so that the tank pressure detected by the sensor 11 increases rapidly to the atmospheric pressure. The pressure reducing part 63 stores the tank pressure measured at the end of the pressure reducing mode, in the RAM 93 as P4. The leak checking part 65 stores the tank pressures measured immediately after (for example, t5=0.1 second) the start of the leak checking mode and a predetermined period of time (for example, t6=5 seconds) after the start of leak checking mode, in the RAM 93 as P5 and P6, respectively. Further, the pressure reducing part 63 stores the period of time required for the pressure reducing process, as T4.

The large hole judging part 78 judges the presence of the large hole if all the judgment conditions (1) to (6) are met. These conditions are shown as follow.

(1) The presence of leakage is judged in the internal pressure monitoring, that is, the first leak presence flag is set to one.

(2) P3−P2≦predetermined value S1 is established. The predetermined value S1 is, for example, 133.3 Pa.

(3) P5−P4>predetermined value S2 is established. The predetermined value S2 is, for example, 1066.6 Pa.

(4) |P1−P5|<predetermined value S3 is established. The predetermined value S3 is, for example, 400.0 Pa.

(5) P6−P5<predetermined value S4 is established. The predetermined value S4 is, for example, 200.0 Pa.

(6) The pressure reducing processing time T4 is larger than a predetermined value S5. The predetermined value S5 is, for example, 5.5 seconds.

The internal pressure monitoring part 57 detects leakage from a hole of diameter 1 mm or larger. Therefore, the condition (1) is of course met if there is a large hole. The condition (2) is met if there is a large hole because the pressure does not substantially increase from the atmospheric pressure in the correction checking mode. The condition (3) is met if there is a large hole because the tank pressure actually remains near the atmospheric pressure, so that the tank pressure varies sharply immediately after the start of the leak checking process. The condition (4) is met if there is a large hole because the tank pressure recovers to a neighborhood of the atmospheric pressure immediately after the start of the leak checking process. The condition (5) is met if there is a large hole because the tank pressure does not vary after recovering to a neighborhood of the atmospheric pressure in the leak checking mode.

The condition (6) is used to distinguish from a case where a float valve 46 that is operated when the tank is filled with a fuel is operating. When the float valve 46 is operating, the presence of a large hole is judged for systems that do not include the fuel tank 9, so that it cannot be judged whether there is actually a large hole in the fuel tank. When the float valve 46 is operating, the pressure reducing processing time T4 is very short. Therefore, the presence of a large hole is judged only if a predetermined period of time or longer has been spent in the pressure reducing process.

If all of the above-mentioned conditions (1) to (6) are met, the large hole judging part 78 judges the presence of a large hole and sets one in a large hole presence flag. In this manner, the presence of a large hole can be accurately detected. In another embodiment, only some of the above-mentioned judgment conditions (1) to (6) may be used to judge whether there is a large hole.

A MIL lighting controller 81 sets a lighting flag to one to light the MIL 36 if either the first leak presence flag from the first leak judging part 77, the second leak presence flag from the second leak judging part 79, and a signal from another troubleshooting device indicating the presence of a failure (this signal is hereafter referred to as an other failure presence flag) has been set to one. The other failure presence flag indicates failures other than the above-mentioned leakage which are detected by vehicle-mounted diagnosis devices, for example, deterioration of a catalyst or failures in various sensors such as a throttle sensor and a wide-range idle fuel consumption sensor. Thus, this flag is set to one if any of such failures is detected. The lighting flag is a control signal set by the MIL lighting controller 81 to drive the MIL 36, and is set to one for lighting or to zero for turning off.

Once the MIL lighting controller 81 has lit the MIL 36 in response to some detection of leakage from other than a large hole or of another failure, it does not automatically turn off the MIL during driving unless the diagnosis is judged to be erroneous. On the other hand, when the MIL lighting controller 81 lights the MIL 36 in response to leakage from a large hole, and then the lighted MIL 36 is automatically turned off by the MIL lighting controller 81 responsive to termination of detection of leakage.

Figure 7:
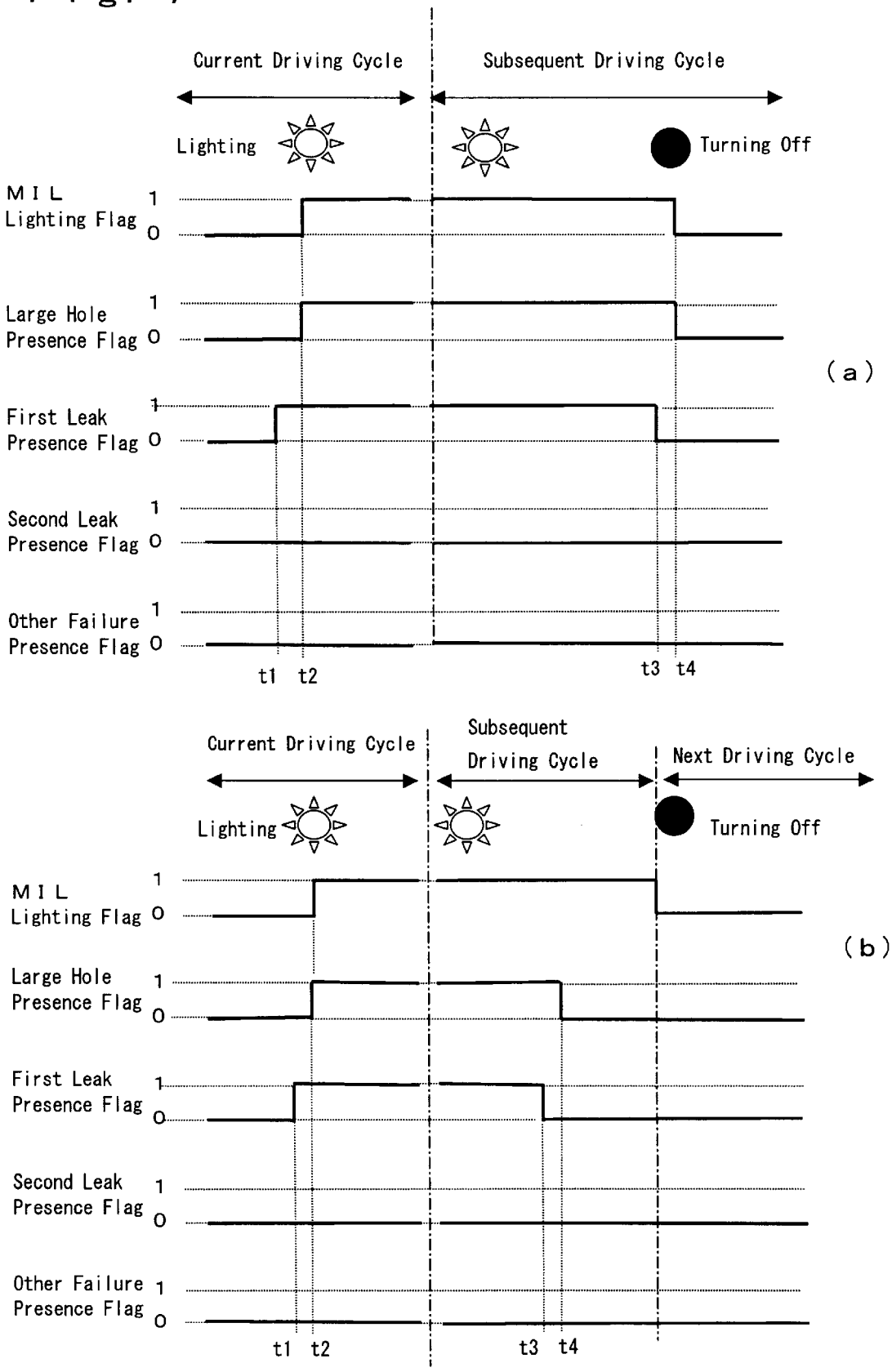
FIG. 7(A) is a diagram showing one example of timing of turning on and off a MIL in accordance with one embodiment of the present invention, and FIG. 7(B) a diagram showing another example of turning on and off a MIL in accordance with another embodiment of the present invention.

FIG. 7 shows two preferable examples of timings with which the MIL is lit and turned off in connection with the judgment of the presence of a large hole. Referring to the first example in FIG. 7(*a*), when the first leak judging part 77 detects a first leak at a time t1 during the current driving cycle, the first leak presence flag is set to one. When the large hole judging part 78 subsequently detects a large hole at a time t2, the large hole presence flag is set to one. These flags are stored in the RAM 93. The MIL lighting controller 81 checks the first leak presence flag. Since this flag has been set to one, the MIL lighting controller 81 sets the lighting flag to one to light the MIL 36.

Since the leak judgment and the large hole judgment in this embodiment are carried out only once during one driving cycle, when the MIL 36 is lit once during a certain driving cycle, it keeps lighting throughout this driving cycle. In FIG. 7(*a*), the MIL 36 is lit at the time t2. In another embodiment, the first leak presence flag may be checked to light the MIL 36 at the time t1.

Then, when, for example, the user closes the filler cap to eliminate the large hole between the time t2 and a time t3, the first leak judgment executed at the time t3 during the subsequent driving cycle detects no leakage and the first leak presence flag is thus set to zero. The large hole judgment subsequently executed at a time t4 detects no large hole, and the large hole presence flag is thus set to zero.

The MIL controller 81 checks at the time t4 whether the first leak presence flag has been set to zero, and if so, it further checks whether the large hole presence flag has changed from one to zero. If the first leak presence flag has been set to zero and the large hole presence flag has changed from one to zero, it is judged that the first leak presence flag set during the last driving cycle (this corresponds to the current driving cycle in FIG. 7(A)) is due to a large hole and that the large hole has been eliminated during the current driving cycle (this corresponds to the subsequent driving cycle in FIG. 7(A)). As a result, if the other failure presence flag has been set to zero, zero is set in the lighting flag to turn off the MIL 36.

Thus, the MIL, which has been lit because of leakage from a large hole, can be turned off in a timely manner in response to the elimination of the large hole. This example prevents that the MIL continues to be on despite termination of detection of leakage after the large hole has been eliminated. with the second example in FIG. 7(*b*), when the first leak judging part 77 detects a first leak at a time t1 during the current driving cycle, the first leak presence flag is set to one. When the large hole judging part 78 subsequently detects a large hole at a time t2, the large hole presence flag is set to one. These flags are stored in the RAM 93. The MIL lighting controller 81 checks the first leak presence flag. Since this flag has been set to one, the MIL lighting controller 81 sets the lighting flag to one to light the MIL.

If the large hole has been eliminated between the time t2 and a time t3, the first leak judgment executed at the time t3 during the subsequent driving cycle detects no leakage and the first leak presence flag is thus set to zero. The large hole judgment subsequently executed at a time t4 detects no large hole, and the large hole presence flag is thus set to zero.

The MIL controller 81 checks at the start of the next driving cycle whether the first leak presence flag was set to zero during the last driving cycle (this corresponds to the subsequent driving cycle in FIG. 7(*b*)), and if so, it further checks whether the large hole presence flag, which was set to one during the large hole judgment in the driving cycle before last (this corresponds to the current driving cycle in FIG. 7(*b*)), changed to zero during the large hole judgment in the last driving cycle. If the first leak presence flag showed zero and the large hole presence flag changed from one to zero during the last driving cycle, it is judged that the first leak presence flag set during the driving cycle before last is due to leakage from a large hole and that the large hole was eliminated during the last driving cycle. As a result, if the other failure presence flag has been set to zero, zero is set in the lighting flag to turn off the MIL 36. With this example, the MIL, which was lit due to leakage from a large hole, is also prevented from continuing lighting after the large hole has been eliminated.

The functional blocks have each been described with reference to FIG. 2. Processes executed by these functional blocks will be specifically shown in a flowchart. In this flowchart, the tank pressures P1 to P6, the pressure reducing processing time T4, and the predetermined values S1 to S5 have the same meaning as shown in the judgment conditions (1) to (6). In addition, the first and second leak presence flags and large hole presence flag are initially set to zero when each driving cycle is started.

Internal Pressure Monitoring

Next, the internal pressure monitoring process which is implemented by the internal pressure monitoring part 57 will be described with reference to FIGS. 8 and 9.

Figure 8:
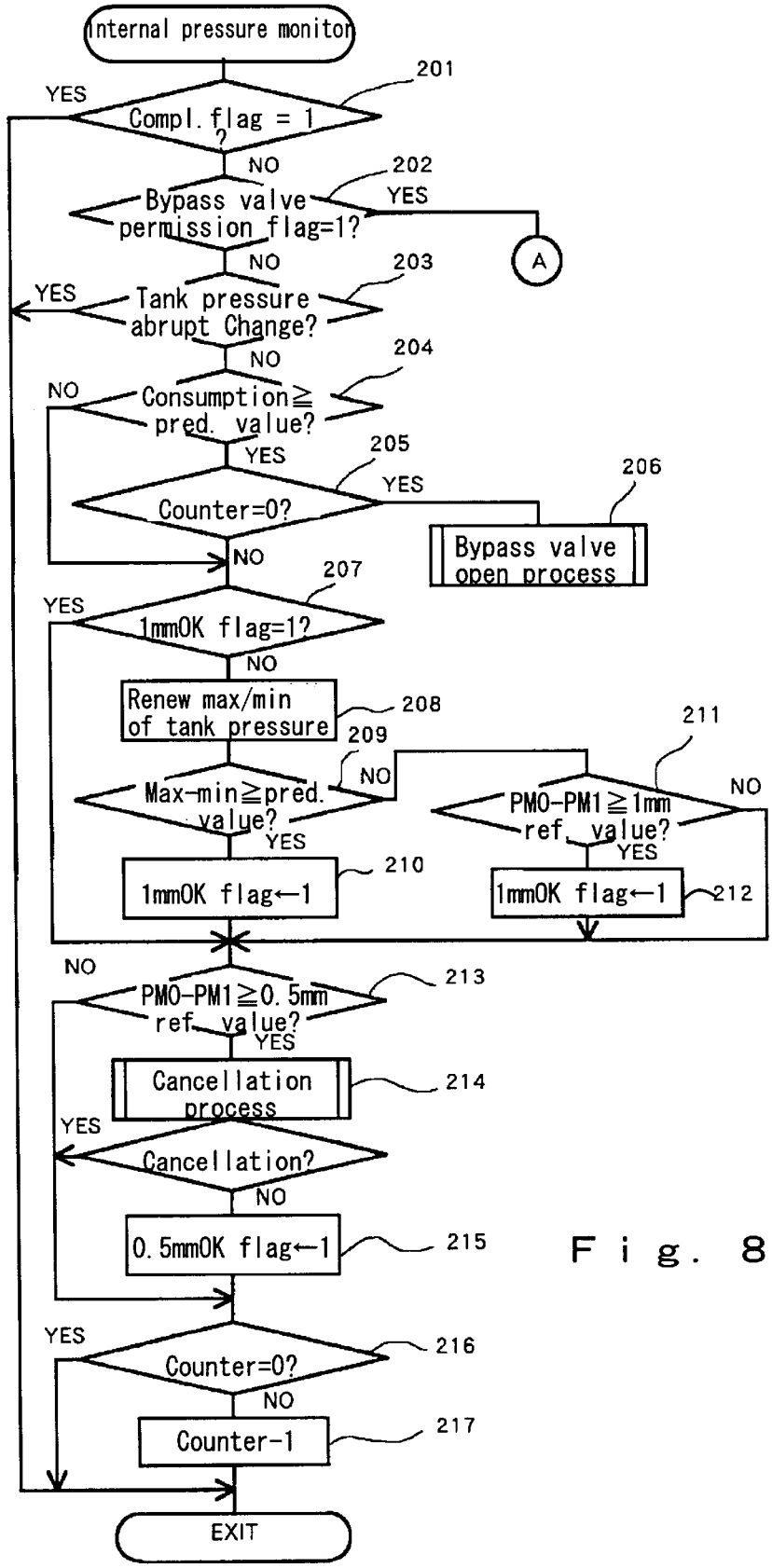
FIG. 8 is a flow chart illustrating internal pressure monitoring in accordance with one embodiment of the present invention.

In cases where a completion flag, which is set at one when the series of internal pressure monitoring processes is completed, is not one (201), the process shown in FIG. 8 is initiated. In a state in which a bypass valve permission flag, which is set at one in the process that will be described later with reference to FIG. 9, is one (202), the process proceeds to FIG. 9. In cases where this bypass valve permission flag is not one, the process proceeds to the process of step 203 and subsequent steps.

A judgment is made as to whether or not there has been an abrupt change in the tank pressure by determining whether or not the absolute value of the difference between the currently detected tank pressure and the tank pressure previously detected and stored in the RAM 93 is equal to or greater than a predetermined value (203). For example, an abrupt change in the tank pressure occurs when the fuel level oscillates as a result of abrupt starting of the vehicle into motion such that the fuel contacts the wall surfaces of the tank and is abruptly vaporized. Such conditions are not suitable for detecting vapor leakage. Accordingly, the process is exited in such cases.

If it is judged that there has been no abrupt change in the tank pressure, the process shifts to step 204, and a judgment is made as to whether or not the amount of fuel consumption is equal to or greater than a predetermined value. If the amount of fuel consumption is equal to or greater than this predetermined value, and the countdown timer is at zero, then the process proceeds to a bypass-valve-open process that will be described later (206). This indicates a state in which a 1 mm OK flag is not set at one, i.e., the 1 mm diameter criteria is not cleared, even though the process from step 207 on in FIG. 8 has been performed a predetermined number of times.

The calculation of the amount of fuel consumption in step 204 uses values calculated in the background of the process. Specifically, in the background, the CPU 91 multiplies the sum of the valve opening time of the fuel injection valve 6 in a predetermined period by a predetermined coefficient, and thus converts this value into the amount of fuel consumption during this predetermined period. This value is stored in the RAM 93, and is rewritten at predetermined intervals.

In cases where the amount of fuel consumption is smaller than a predetermined value in step 204, or in cases where the counter value is not zero in step 205, i.e., in cases where the predetermined number of repetitions of monitoring has not been reached, the process shifts to step 207, and a check is made in order to ascertain whether or not the 1 mm OK flag is one. This 1 mm OK flag is set in cases where the 1 mm diameter criteria is cleared in the post-start open process (FIG. 3), or in step 210 or 212 described later.

If the 1 mm OK flag is not set at one, the process proceeds to step 208. Here, if the tank pressure currently indicated by the sensor 11 or the mean value obtained by sampling the output of the sensor 11 a predetermined number of times (in the present specification, the simple term "current tank pressure" may refer to a single measured value or the mean value of values sampled a plurality of times, depending on the nature of the process) is greater than the maximum value of the tank pressure stored in the RAM 93 up to that time, the maximum value in the RAM 93 is rewritten as the current tank pressure, and if the current tank pressure is smaller than the minimum value of the tank pressure stored in the RAM 93 up to that time, the minimum value stored in the RAM 93 is rewritten as the current tank pressure.

If the difference between the maximum value and minimum value thus updated, i.e., the amplitude of the shift in the tank pressure, is equal to or greater than a predetermined value (209), it is judged that there is no leakage caused by a hole with a diameter of 1 mm or greater, and the 1 mm OK flag is set at one (210). Here, the predetermined value used in this judgment is a value read out from a map (using the engine water temperature (TW) at the time of starting as a parameter) stored in the ROM 92.

In cases where the amplitude of the shift in the tank pressure is smaller than the above-mentioned predetermined value, the process shifts to step 211. Here, if the difference between the tank pressure PM0 measured with the system open to the atmosphere and stored in the RAM 93 in the post-start open process and the current tank pressure PM1 obtained from the internal pressure sensor 11 is equal to or greater than the reference value, e.g., 266.6 Pa, used to detect leakage caused by a hole with a diameter of 1 mm or greater (211), it is judged that the tank system has the function of maintaining a negative pressure, and that there is no leakage according to the lmm diameter criteria. Accordingly, the 1 mm OK flag is set at one (212).

In step 213, a judgment is made as to whether or not the value of PM0−PM1 is equal to or greater than the reference value for the 0.5 mm diameter criteria, e.g., 666.6 Pa. If the value of PM0−PM1 is equal to or greater than this reference value, it is tentatively judged that the tank system has the function of maintaining a large negative pressure, and that there is no leakage according to the 0.5 mm criteria. However, the tank pressure may assume a negative value as a result of special factors regardless of the presence or absence of leakage. The special factors that might possibly affect the 0.5 mm OK judgment include conditions in which the vehicle is operating under a high load, and conditions in which the vehicle is moving from a high place to a low place so that the atmospheric pressure varies greatly in the direction of increase. Accordingly, the process enters a cancellation process subroutine of step 214, and a judgment is made as to whether or not such special factors are present. If it is judged in this subroutine that no special factors are present (that is, if it is decided not to cancel the judgment results of step 213), a 0.5 mm OK flag is set (215), and if the time counter has not reached zero (216), the process is exited after subtracting 1 from the time counter (217). If the time counter has reached zero, the process is exited.

In the working example shown in FIG. 8, the program that executes the internal pressure monitoring process is invoked at predetermined time intervals, e.g., every 80 milliseconds, and this process is repeated until the time counter reaches zero (205). When the time counter reaches zero, the process shifts to the bypass-valve-open process (206) which is shown in detail in FIG. 9. In the bypass-valve-open process, the internal pressure monitoring completion flag is set in step 312 or 313. When this flag is set, the process in FIG. 8 detects this flag in step 201, and the process is exited.

Bypass-Valve-Open Process

Next, the bypass-valve-open process will be described with reference to FIG. 9. This process is entered when the value of the time counter reaches zero in the process shown in FIG. 8 (205). Furthermore, this process is entered from step 304 in FIG. 9 in cases where it is detected that the bypass valve permission flag is set in the process shown in FIG. 8. A judgment is made as to whether or not the maximum value of the tank pressure updated in step 208 in FIG. 8 is greater (by a predetermined amount or more) than the tank pressure PM0 measured with the system open to the atmosphere, which was detected in the post-star open process shown in FIG. 3 and stored in the RAM 93 (301). If this maximum value of the tank pressure is greater than PM0 by the above-mentioned predetermined value or more, this means that the tank system had the function of maintaining a positive pressure from the time of starting onward. Accordingly, the internal pressure monitoring completion flag is set (313), and the process is ended. The predetermined value used in the judgment performed in step 301 is a value which uses the engine water temperature (TW) at the time of starting as a parameter, and is stored in tabular form in the ROM of the ECU 5.

Figure 9:
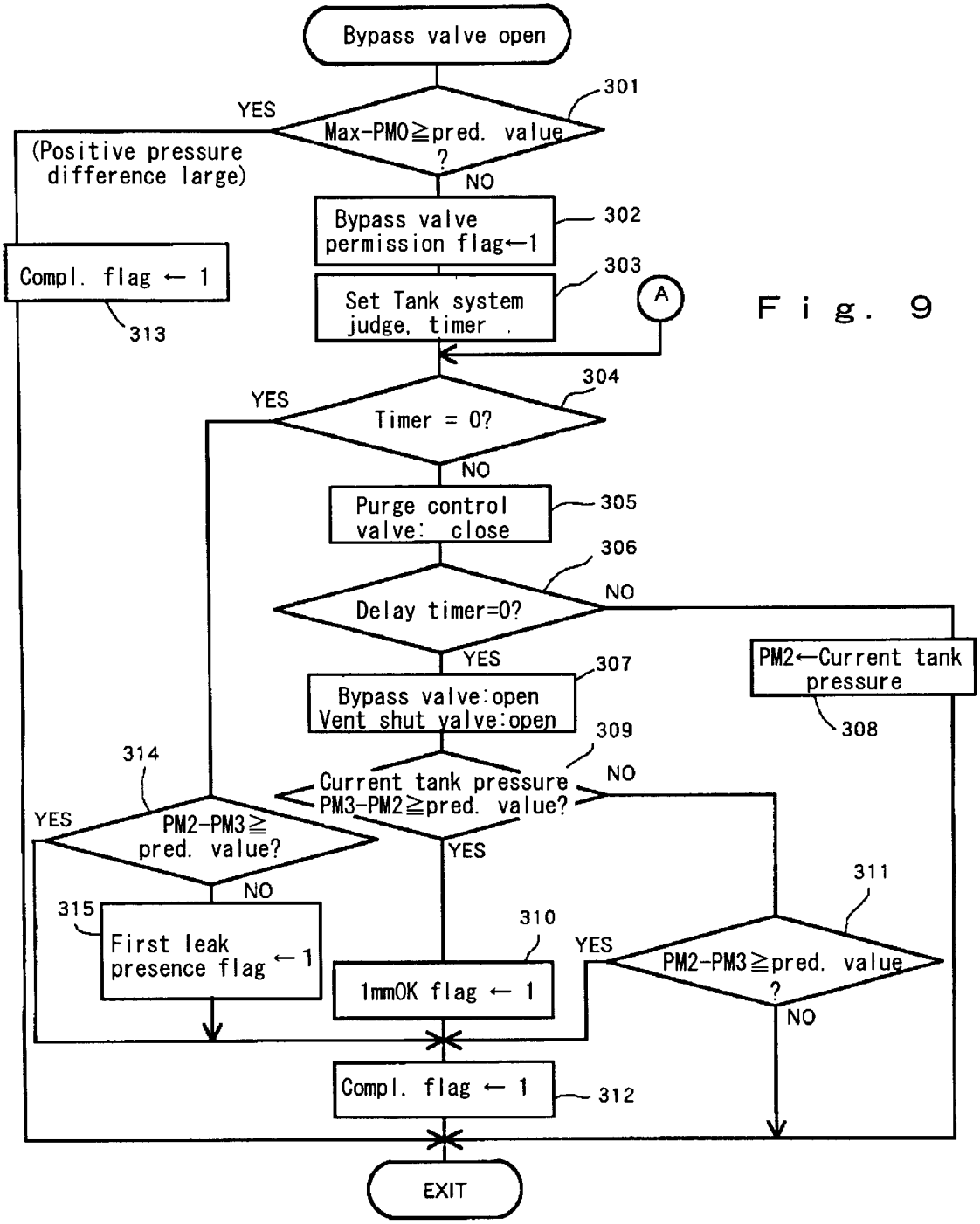
FIG. 9 is a flow chart illustrating a bypass-valve-open process in accordance with one embodiment of the present invention.

In cases where the result of the comparison made in step 301 is "no", the permission flag for opening the bypass valve is set (302), and the predetermined time that is to be spent on the process shown in FIG. 9 is set in a tank system judgment timer (303). Since the timer value thus set is not initially zero, the process proceeds to step 305 via step 304, and the purge control valve 30 is closed. Step 306 is a step that waits for the closing of the purge control valve to stabilize. Since the delay timer has not reached zero at first, the process proceeds to step 308, and the current tank pressure PM2 is stored in the RAM 93.

Like the processing routine shown in FIG. 8, the processing routine shown in FIG. 9 is also invoked at predetermined time intervals, e.g., every 80 milliseconds. Accordingly, after the process is exited via step 308, the process again enters this process, and if the delay time is at zero, the ECU 5 sends control signals and opens the bypass valve and vent shut valve so that the tank system is opened to the atmosphere (307). In step 309, a judgment is made as to whether or not the current tank pressure PM3 following the above-mentioned opening to the atmosphere has increased by a predetermined value or greater from the tank pressure PM2 measured prior to the above-mentioned opening to the atmosphere. If the current tank pressure PM3 has increased by this predetermined value or greater, this indicates that the tank system had the function of maintaining a negative pressure. Accordingly, it is judged that there was no leakage caused by a hole with a diameter of 1 mm or greater. Consequently, the 1 mm OK flag is set (310), the internal pressure monitoring completion flag is set, and the process is exited (312).

In cases where the shift from negative pressure toward atmospheric pressure has not reached the above-mentioned predetermined value in step 309, the process shifts to step 311, and a judgment is made as to whether or not PM2−PM3 is equal to or greater than a predetermined value, i.e., as to whether or not the tank pressure PM3 following the above-mentioned opening to the atmosphere is smaller than the tank pressure PM2 measured prior to the above-mentioned opening to the atmosphere by a predetermined value or greater (that is, whether or not the tank pressure showed a large shift toward atmospheric pressure from a positive pressure). The predetermined value used here may be different from the predetermined value used in step 309. Typically, a value read out from a table (using the water temperature (TW) at the time of engine starting as a parameter) stored in the ROM of the ECU 5 is used.

If the pressure shift is large, this means that the tank system had the function of maintaining pressure. However, a shift from a positive pressure is not suitable for detecting the presence or absence of leakage caused by very small holes. Accordingly, the completion flag is set (312) without setting the OK flag, and the process is exited. In cases where it is judged in step 311 that the shift in the pressure is not large, the judgment process is repeated. Accordingly, the process is exited without setting the completion flag.

When the judgment process is repeated and the tank system judgment timer reaches zero (304), a judgment similar to that of step 311 is made in step 314. If the shift toward atmospheric pressure from a positive pressure is sufficiently large, the completion flag is set and the process is ended. If the shift is not sufficiently large, it is judged that there is leakage in the tank system, the first leak presence flag is set (315), after which the completion flag is set and the process is ended. The first leak presence flag is used for the above-mentioned a large hole judgment condition (1).

Then, the opening-to-atmosphere process, correction checking process, pressure reducing process, leak checking process, and vapor checking process which constitute the reduced tank-pressure monitoring will be sequentially explained. Each process routine is invoked at predetermined time intervals (for example, 80 milliseconds) as described above until a reduced tank-pressure monitoring completion flag is set to one or until the process routine shifts to the next one.

Opening to Atmosphere Mode

Figure 10:
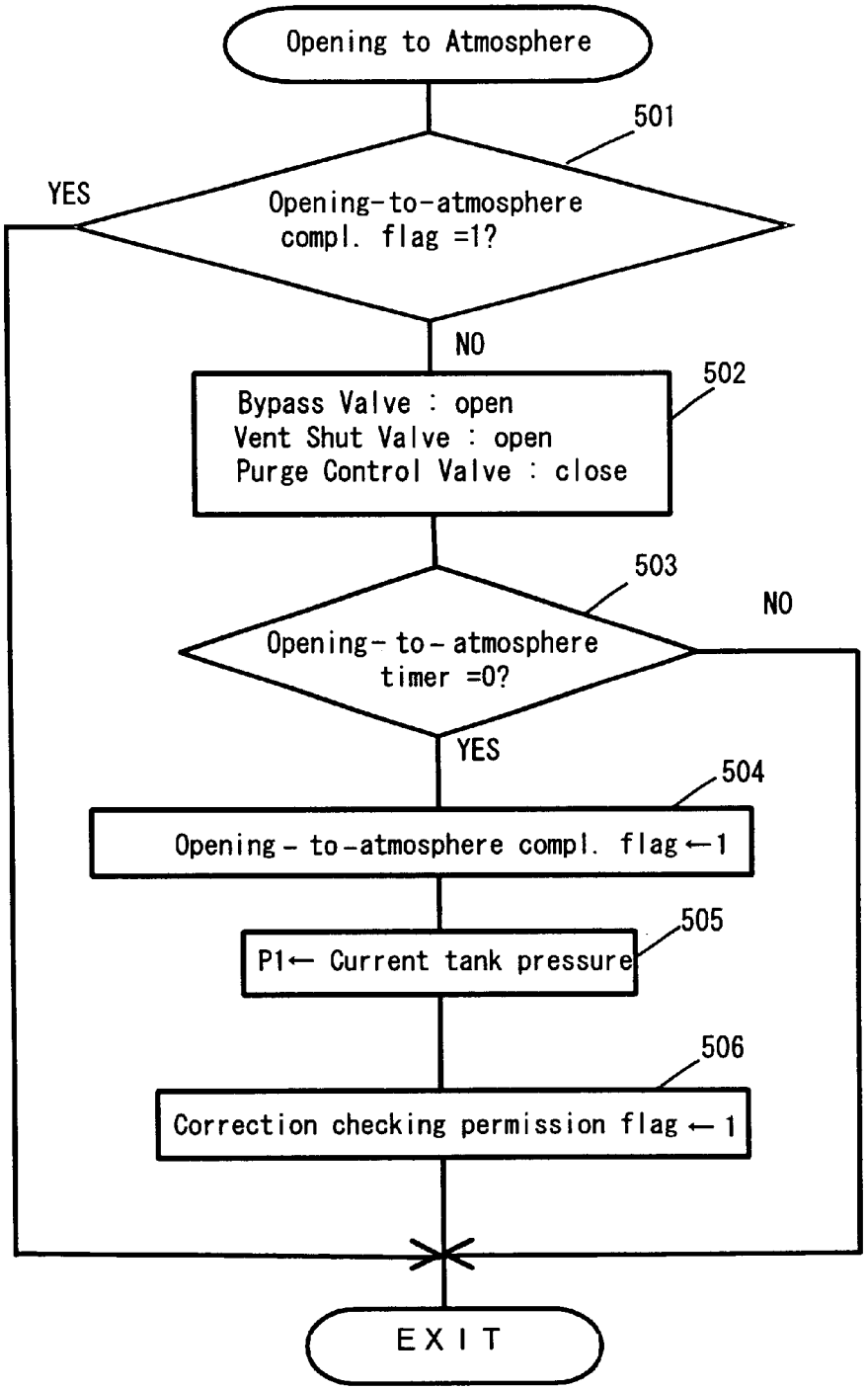
FIG. 10 is a flow chart illustrating an opening-to-atmosphere process in accordance with one embodiment of the present invention.

FIG. 10 shows a flowchart of the opening-to-atmosphere process executed by the opening-to-atmosphere part 61. When a completion flag, which is set to one when the opening-to-atmosphere process is completed, has not been set to one (501), the process in FIG. 10 is started. At step 502, the bypass valve and the vent shut valve are opened and the purge control valve is closed to open the entire discharge prevention system 31 to the atmosphere. When an opening-to-atmosphere timer comprising a down timer reaches zero, indicating that a predetermined period of time has passed (503), the process proceeds to step 504 to set one in the opening-to-atmosphere completion flag. The process proceeds to step 505 to store an output from the internal pressure sensor 11 in the RAM 93 as the tank pressure P1. The tank pressure P1 is used for the above-mentioned large hole judgment condition (4). When the opening-to-atmosphere process is completed, one is set one in a correction checking permission flag for the following correction checking process (506).

Correction Checking Mode

Figure 11:
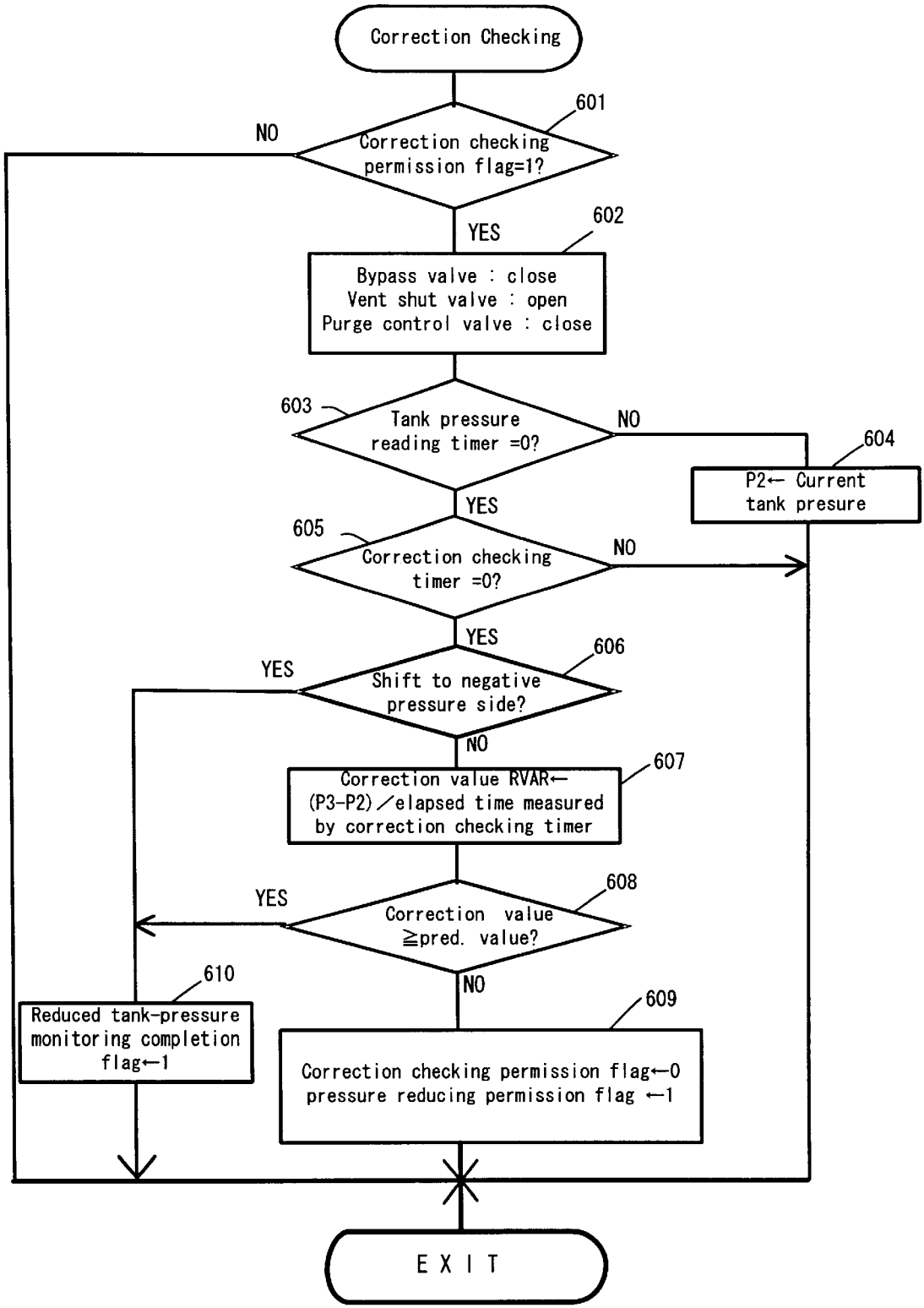
FIG. 11 is a flow chart illustrating a correction checking process in accordance with one embodiment of the present invention.

FIG. 11 is a flow chart showing the correction checking process executed by the correction checking part 62, which calculates the correction value. If, in step 601, the correction checking permission flag, which is set to one upon the completion of the process of the opening-to-atmosphere process, has been set to one, the process advances to step 602, and the correction checking process is initiated. In step 602, the bypass valve 24 and purge control valve 30 are closed, and the vent shut valve 26 is opened.

The process advances to step 603, and if a tank pressure reading timer is not at zero, the process advances to step 604. Here, the output of the internal pressure sensor 11 is detected and is stored in the RAM 93 as the initial value P2 of the current tank pressure. The reason for the installation of the tank pressure reading timer is to read the tank pressure when the pressure has become settled to some extent following the passage of a predetermined amount of time, since the tank pressure fluctuates when the bypass valve 24 is closed from an open state.

If the tank pressure reading time is at zero in step 603, i.e., if a predetermined amount of time has elapsed, the process proceeds to step 605, and a judgment is made as to whether or not a correction checking timer is at zero. The correction checking timer is used in order to ascertain whether or not the time required for the calculation of the correction value has elapsed. This timer is set at a larger value than the above-mentioned tank pressure reading time. If the correction checking timer is at zero, the process proceeds to step 606.

In step 606, the current tank pressure P3 and the initial value P2 of the tank pressure stored in step 604 are compared, and a judgment is made as to whether or not the tank pressure has fluctuated toward the negative pressure side by a predetermined value or greater. If the pressure shifts toward the negative pressure side, it indicates that the evaporated fuel is in a liquefied state as a result of a drop in the temperature inside the fuel tank, so that an appropriate correction value cannot be obtained. Accordingly, the process proceeds to step 610, the reduced tank-pressure monitoring completion flag is set a tone so that the reduced tank-pressure monitoring in this driving cycle is prohibited.

If there is no shift to the negative pressure side in step 606, the process proceeds to step 607, and a correction value RVAR indicating the amount of shift in the tank pressure per unit time is calculated according to the equation shown below.

$$\text{Correction value } RVAR=(P3-P2)/\text{elapsed time measured by the correction checking timer} \quad \text{(Formula 1)}$$

The process proceeds to step 608. If the calculated correction value RVAR is equal to or greater than a predetermined value, there is a possibility that the tank pressure will adhere to the positive pressure side control pressure of the two-way valve 23 as a result of the generation of large amounts of vapor. The value calculated in such a state is not an appropriate correction value. Accordingly, the process proceeds to step 610, the reduced tank-pressure monitoring completion flag is set at one so that the reduced tank-pressure monitoring is prohibited. If the correction value RVAR is smaller than the above-mentioned predetermined value, the process proceeds to step 609, the correction checking permission flag is set at zero, and a pressure reducing permission flag is set at one in order to perform the following pressure reducing process. The correction value RVAR and the value "P3−P2" thus obtained is stored in the RAM 93, and is used in the vapor checking process and the above-mentioned large hole judgment condition (2) respectively.

Pressure Reducing Mode

Figure 12:
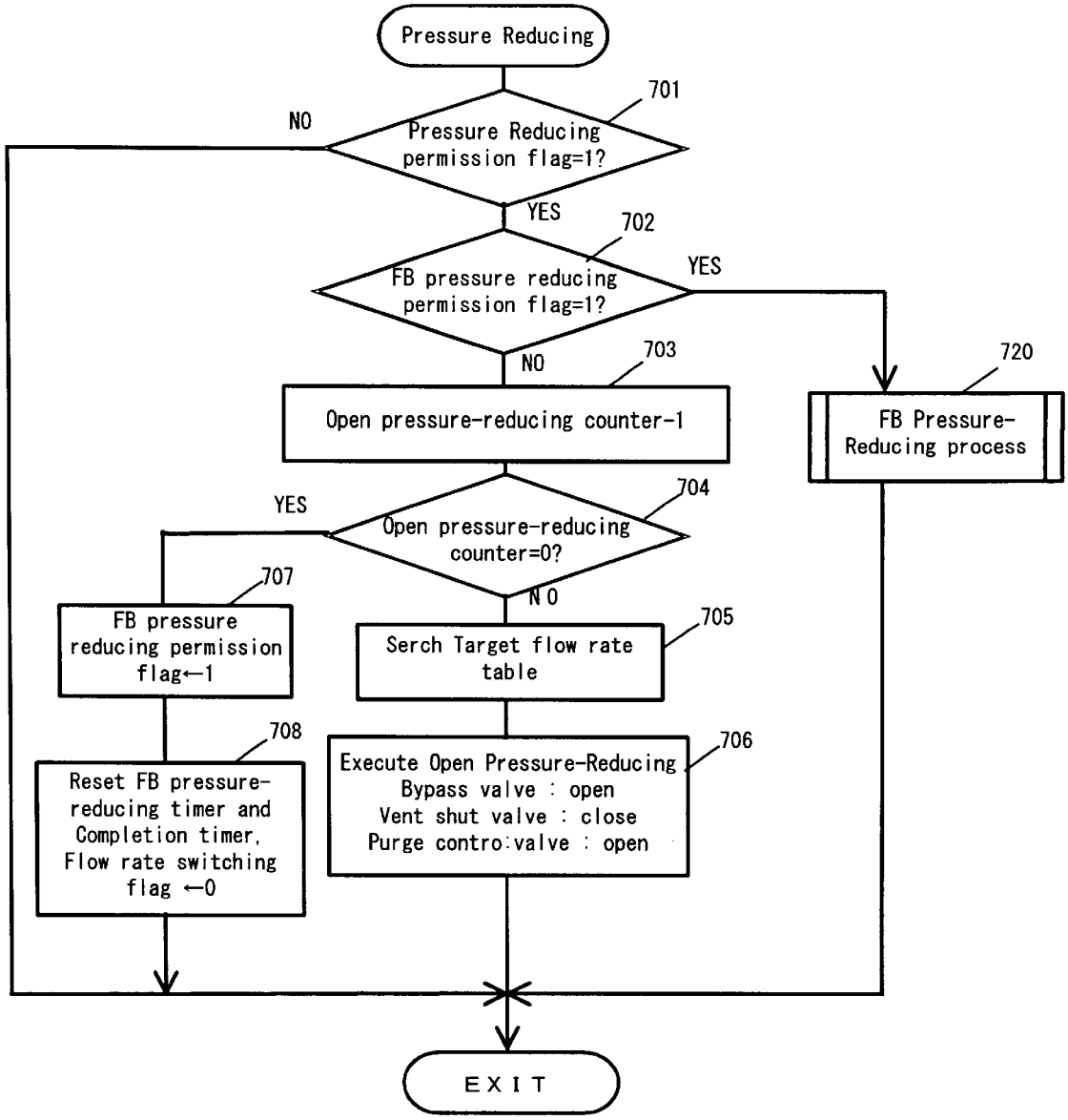
FIG. 12 is a flow chart illustrating a pressure reducing process in accordance with one embodiment of the present invention.
Figure 13:
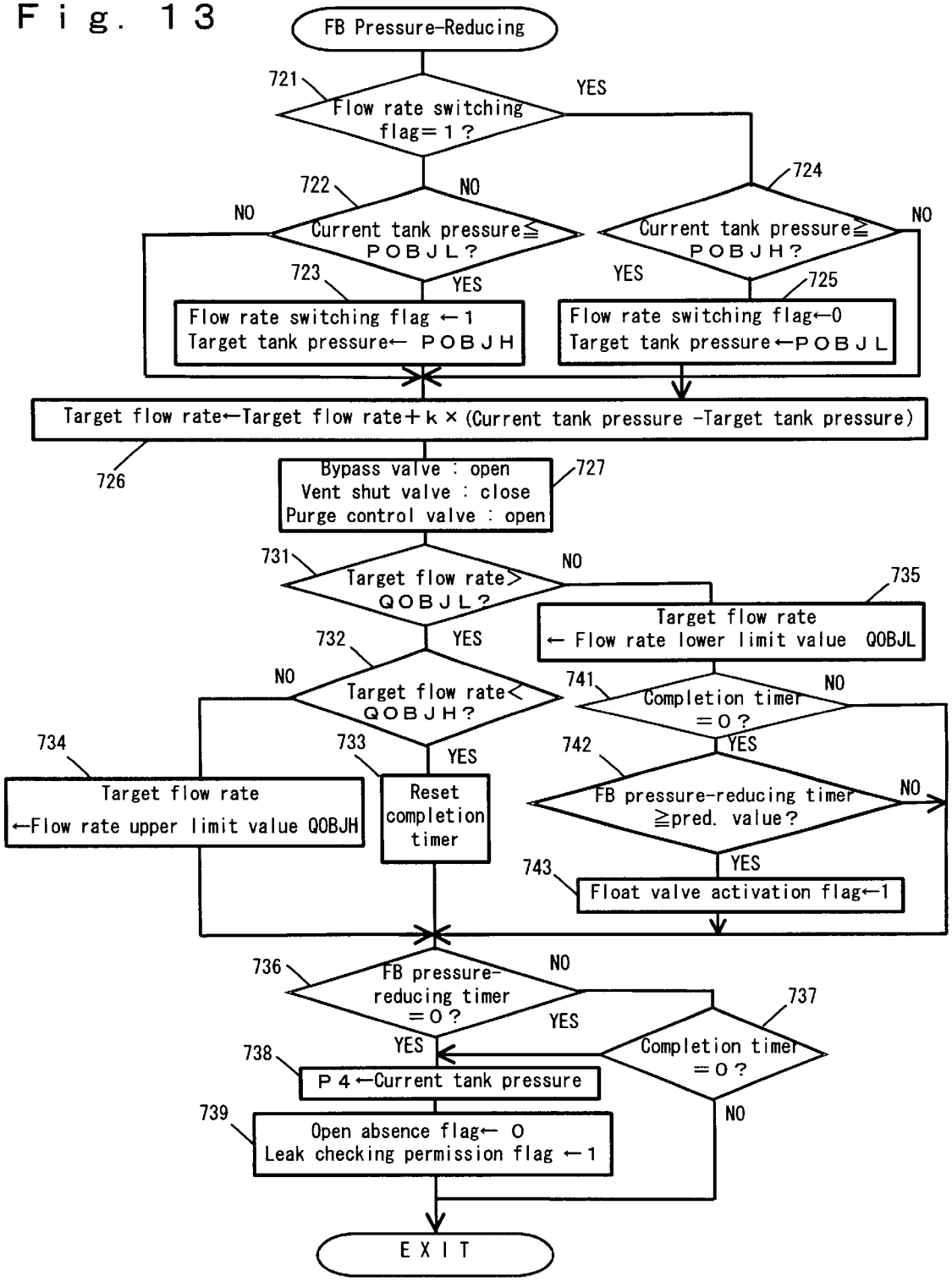
FIG. 13 is a flow chart illustrating a feedback pressure-reducing process in accordance with one embodiment of the present invention.

FIGS. 12 and 13 show flowcharts of a pressure reducing process executed by the pressure reducing part 63. When the pressure reducing permission flag, which is set when the correction checking process is completed, has been set to one, the pressure reducing process is started (701). Further, if a FB pressure reducing permission flag, which is set when the open pressure reducing is completed, has been set to one, the process enters a subroutine for the FB pressure reducing (702). Since the FB pressure reducing permission flag is initially set to zero, the process proceeds to step 703 to decrement the open pressure reducing counter by one and judges whether the counter shows zero (704). If the counter shows a value other than zero, a target flow rate table stored in the ROM 92 is searched (705) to determine a target purge flow rate depending on the current tank pressure. The purge control valve is then opened by an amount corresponding to the determined target purge flow rate. Further, the bypass valve is opened while the vent shut valve is closed to execute the open pressure reducing process in order to reduce the pressure of the tank system (706). This open pressure reducing process is repeated a number of times as indicated by the open pressure reducing counter, as shown in step 703.

If the counter reaches zero at step 704, one is set in the FB pressure reducing permission flag (707), an FB pressure reducing timer and a completion timer used for the FB pressure reducing process are set to predetermined times (for example, 30 and 5 seconds, respectively), and zero is set in a flow rate switching flag (708).

FIG. 13 shows a subroutine for the FB pressure reducing process. After the open pressure reducing process in FIG. 12 has been completed and one has been set in the FB pressure reducing permission flag (707), the FB pressure reducing subroutine is executed when it is judged that the FB pressure reducing flag has been set to one.

It is judged at step 721 whether the flow rate switching flag has been set to one. Since this flag is set to zero when the open pressure reducing process is completed (step 708 in FIG. 12), the process proceeds to step 722. If the current tank pressure has reached the lower limit value POBJL, the flow rate switching flag is set to one to switch the target tank pressure to the upper limit value POBJH (723). On the contrary, if at step 721, the flow rate switching flag has been set to one and the current tank pressure has reached the upper limit value POBJH, the switching flag is set to zero to switch the target tank pressure to the lower limit value POBJL (724 and 725). In this manner, by alternately switching the target tank pressure between the upper limit value and the lower limit value, the current tank pressure is converged between the upper limit value and lower limit value of the target tank pressure.

The process proceeds to step 726 to calculate a target purge flow rate based on the difference between the target tank pressure and the current tank pressure. In this calculation, "k" denotes a coefficient for converting pressure into purge flow rate. At step 727, the bypass valve is opened while the vent shut valve is closed, the purge control valve is opened by an amount corresponding to the target purge flow rate calculated at step 726, to execute the FB pressure reducing process.

After the FB pressure reducing process has been started, it is judged at steps 731 and 732 whether the target purge flow rate is between the lower limit value QOBJL and the upper limit value QOBJH. If the purge flow rate is between these values, the completion timer is reset (733). The completion timer is a down timer that is, for example, set for 5 seconds as described above to measure the period of time passed since the target purge flow rate reached the upper limit value or lower limit value. The FB pressure reducing process is completed when the completion timer has reached the value of zero, that is, when a predetermined period of time has passed since the target purge flow rate reached the upper limit value or lower limit value. Accordingly, the timer is reset if the target purge flow rate is within the upper and lower limit values.

If the result of the judgment at step 732 is negative, this means that the purge flow rate has already reached to the upper limit value QOBJH. Accordingly, the target purge flow rate is reset at this upper limit value QOBJH (734). On the other hand, if the result of the judgment at step 731 is negative, this means that the purge flow rate has already reached to the lower limit value QOBJL. Accordingly, the target purge flow rate is reset at this lower limit value QOBJL (735).

It is judged at step 741 whether the completion timer has reached zero, and if so, this means that a predetermined period of time has passed since the purge flow rate reached the lower limit value QOBJL. Thus, the process proceeds to step 742 to judge whether the pressure reducing timer shows a predetermined period of time or longer (for example, 24.5 seconds). For example, since the completion timer is a down timer that is set for 30 seconds as described above, this step judges whether the pressure reducing processing time T4 is 5.5 seconds (corresponding to the predetermined value S5 in the above-mentioned large hole judgment condition (6)) or longer. If the pressure reducing processing time T4 is 5.5 seconds or shorter, the result at step 742 is positive and the process proceeds to step 743. Completion of the pressure reducing process in such a short period of time indicates that because the fuel tank is full and the float valve 46 (FIG. 1) is operating. Thus, the one is set in a float valve activation flag. The float valve activation flag is used for the above-mentioned large hole judgment condition (6). If the pressure reducing processing time T4 is longer than 5.5 seconds, the float valve 46 is not operating. Accordingly, the process advances to step 736 without setting one in the float valve activation flag.

It is judged at step 736 whether the FB pressure reducing timer has reached zero. If it reaches zero after a predetermined period of time has passed, the tank pressure measured when the pressure reducing process is ended is stored in the RAM 93 as P4 (738). If at step 736, the pressure reducing timer has not reached zero but a predetermined period of time (e.g. 5 seconds) has passed since the target purge flow rate reached the lower limit value (737), the process proceeds to step 738 to complete the pressure reducing process. At step 739, one is set in a leak checking permission flag to shift to the following leak checking process, and an open absence flag used for the large hole judgment process is reset.

Leak Checking Mode

Figure 14:
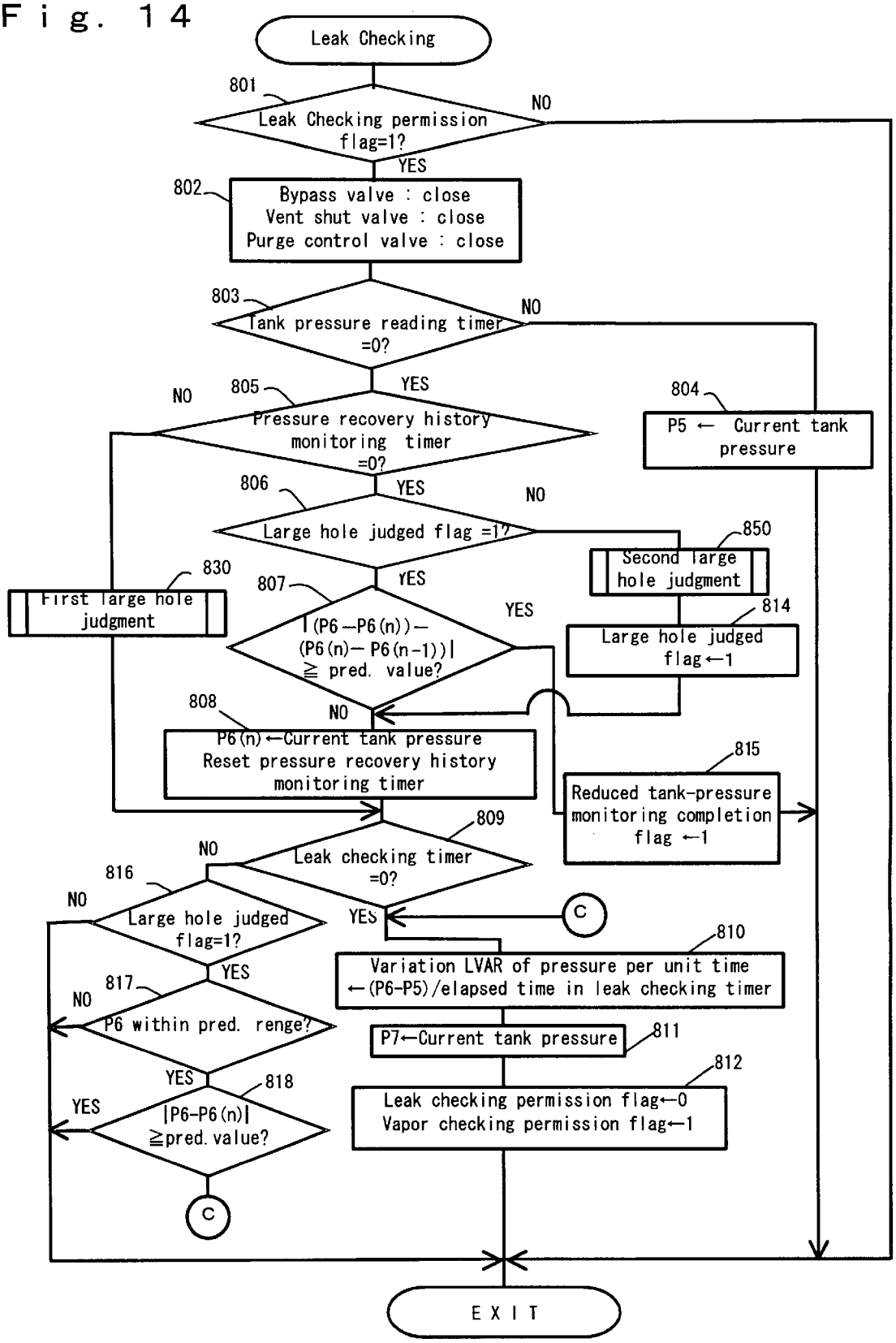
FIG. 14 is a flow chart illustrating a leak checking process in accordance with one embodiment of the present invention.
Figure 15:
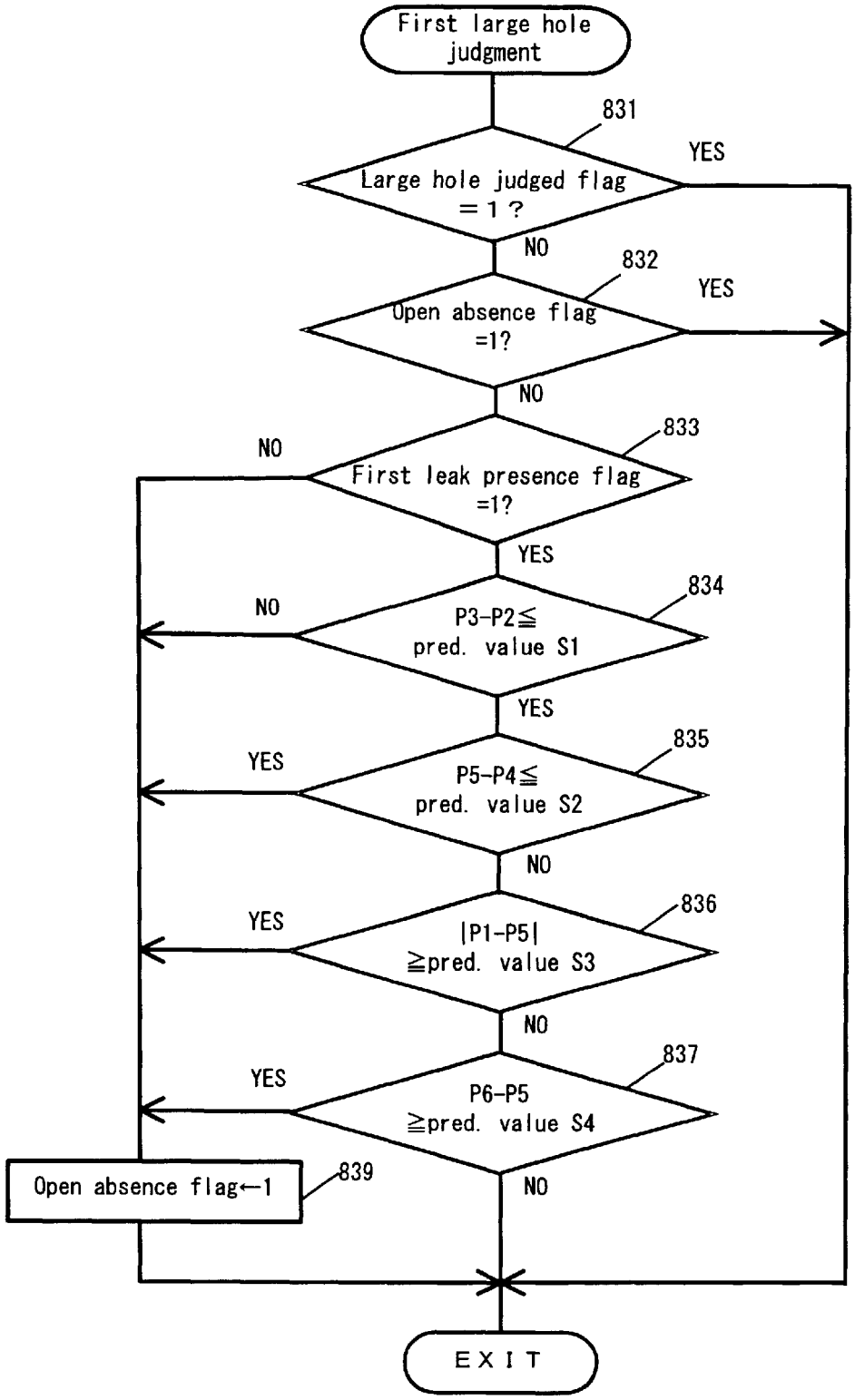
FIG. 15 is a flow chart illustrating a first large hole judgment process in accordance with one embodiment of the present invention.
Figure 16:
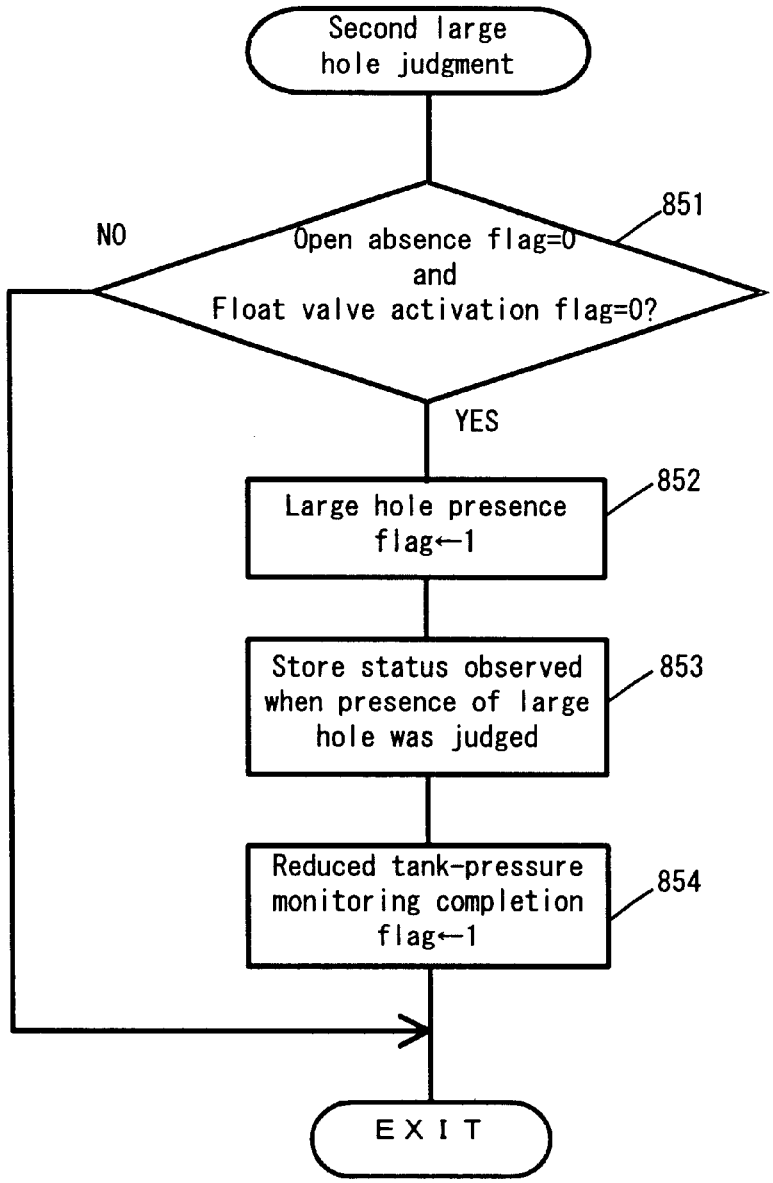
FIG. 16 is a flow chart illustrating a second large hole judgment process in accordance with one embodiment of the present invention.

FIGS. 14 to 16 show a flowchart of a leak checking process executed by the leak checking part 65. If the leak checking permission flag, which is set to one when the pressure reducing process is completed, has been set to one (801), the leak checking process is started.

At step 802, the bypass valve 24, the vent shut valve 26, and the purge control valve 30 are all closed. The process advances to step 803 to judge whether a tank pressure reading timer has reached zero. If not, an output from the internal pressure sensor 11 is detected and the detected tank pressure is stored in the RAM 93 as the initial value P5. (804). The tank pressure reading timer is installed in order to load a value of the tank pressure that has been stabilized after a predetermined period of time has passed, as described above.

If the tank pressure reading timer has reached zero at step 803, it is judged whether a pressure recovery history monitoring timer (that is set, for example, for 5 seconds) has reached zero (805). Since this timer is initially at a value other than zero, the process advances to step 830 to execute a first large hole judgment subroutine. The first large hole judgment subroutine makes judgments for the above-mentioned large hole judgment conditions (1) to (5). After executing the first large hole judgment subroutine, the process proceeds to step 809. Since a leak checking timer has not reached zero, the process advances to step 816. Since a large hole judged flag, which is set after it has been judged whether there is a large hole, has not been set to one, the process routine is exited.

When the process routine is entered again and if the pressure recovery history timer has reached zero (that is, 5 seconds have passed), it is judged whether the large hole judged flag has been set to one (806). Since this flag is not initially set, the process proceeds to step 850 to execute a second large hole judgment subroutine. The second large hole judgment routine makes a judgment for the above-mentioned large hole judgment condition (6), and then finally judges whether there is a large hole. The large hole judged flag is subsequently set to one (814). In this manner, the first and second large hole judgment subroutines are each carried out only once within 5 seconds after the leak checking process has been started.

When the first and second large hole judgments have been executed to set the large hole judged flag to one, pressure recovery history monitoring is started with step 807. The pressure recovery history monitoring comprises storing the tank pressure loaded at step 808 in the RAM 93 in time series for each measuring time of a pressure recovery history timer, which is reset at step 808 (that is, storing the last tank pressure as P6(n), the tank pressure before last as P6(n−1), . . . ), and calculating the variation of the tank pressure at step 807. That is, a difference P6−P6(n) between the current tank pressure P6 and the last tank pressure P6(n) (this difference is defined as ΔPx) as well as a difference P6(n)−P6(n−1) between the last tank pressure P6(n) and the tank pressure before last P6(n−1) (this difference is defined as ΔPy) are calculated. The absolute value |ΔPx−ΔPy| of a difference between ΔPx and ΔPy is larger than or equal to a predetermined value (for example, 400.0 Pa), it is judged that the fuel tank is full and that the float valve is operating. Under these conditions, an appropriate amount of pressure shift cannot be calculated, so that one is set in the reduced tank-pressure monitoring completion flag to prohibit the reduced tank-pressure monitoring during the driving cycle (815).

After the completion of the pressure recovery history monitoring, the process proceeds to step 809 to judge whether the leak checking timer has reached zero. When a predetermined period of time has passed and the leak checking timer has reached zero, the amount of pressure shift LVAR per unit time in the leak checking process is calculated in accordance with Formula 2 based on the current tank pressure P6 and the initial value P5 of the tank pressure stored at step 804 (810). The calculated LVAR is stored in the RAM 93 and used in the vapor checking process.

$$\text{Variation } LVAR \text{ of pressure per unit time} = (P6 - P5)/\text{elapsed time in the leak checking timer} \quad \text{(Formula 2)}$$

The process proceeds to step 811 to detect an output from the internal pressure sensor 11 and store it in the RAM 93 as a tank pressure P7 measured when the leak checking is ended. The process advances to step 812 to set zero in the leak checking permission flag while setting one in a vapor checking permission flag to execute the following vapor checking process.

If the leak checking timer has not reached zero at step 809, it is checked whether the large hole judged flag has been set to one (816). If one has been set, it is judged that whether the current tank pressure P6 is within a predetermined range near the atmosphere pressure (817). If so, the process proceeds to step 818 to judge whether the absolute value |P6−P6(n)| of a difference between the current tank pressure P6 and the last tank pressure P6(n) is larger than or equal to a predetermined value (for example, 133.3 Pa). If the absolute value is smaller than the predetermined value, the pressure has been substantially stabilized and it is unnecessary to wait for the period of time as counted by the leak checking timer. Consequently, the process advances to step 810 to calculate the amount of pressure shift per unit time. The calculation follows Formula 3.

Variation *LVAR* of pressure unit time=(*P6*−*P6*(*n*))/period of time from the start of the leak checking timer till judgment at step 818 (Formula 3)

The tank pressure P5 measured immediately (for example, 0.1 second) after the start of the leak checking process and the tank pressure P6 measured a predetermined amount of time (for example, 5 seconds) after the start of the leak checking process are used for the above-mentioned judgment conditions (3) to (5).

Large Hole Judgment

FIG. 15 shows a flowchart of the first large hole judgment subroutine executed by the large hole judgment part 78 in the above-mentioned step 830. At step 831, it is judged whether the large hole judged flag, which is set at step 814 in FIG. 14, has been set to one. Since this flag has not been set to one when this routine is first entered, the process proceeds to step 832. It is judged at step 832 whether an open absence flag, which is set if any of the large hole judgment conditions fails to be met in step 833 and the subsequent steps, has been set to one. Since this flag has been set to zero when this routine is first entered, the process proceeds to step 833.

Steps 833 to 837 make judgment for the above-mentioned large hole judgment conditions (1) to (5) respectively. Step 833 corresponds to the judgment condition (1) and comprises reading the first leak presence flag stored in the RAM 93 to judge whether the first leak presence flag has been set to one during the internal pressure monitoring (step 315 in FIG. 9). If one has been set, the judgment condition (1) is met and the process advances to step 834.

Step 834 corresponds to the judgment condition (2) and comprises judging whether the amount of pressure shift P3−P2 stored in the RAM 93 in the correction checking process (step 607 in FIG. 11) is smaller than or equal to a predetermined value S1 (for example, 133.3 Pa). If so, the judgment condition (2) is met, the process proceeds to step 835. Step 835 corresponds to the judgment condition (3) and comprises judging whether the difference between the internal tank pressure P5 measured immediately (for example, 0.1 second) after the start of the leak checking process and the internal tank pressure P4 measured when the pressure reducing process is completed is greater than a predetermined value S2 (for example, 1066.6 Pa). If so, the judgment condition (3) is met and the process proceeds to step 836.

Step 836 corresponds to the judgment condition (4) and comprises comparing the internal tank pressure P1 measured at the completion of the opening-to-atmosphere process and stored in the RAM 93 with the internal tank pressure P5 measured immediately after the start of the leak checking process to judge whether the absolute value of the difference therebetween is larger than or equal to a predetermined value S3 (for example, 400.0 Pa). If the absolute value of the difference is smaller than the predetermined value S3, the judgment condition (4) is met and the process proceeds to step 837. Step 837 corresponds to the judgment condition (5) and comprises judging whether the difference between the tank pressure P6 measured a predetermined period of time (for example, 5 seconds) after the start of the leak checking process and the tank pressure P5 measured immediately after the start of the leak checking process is larger than or equal to a predetermined value S4 (for example, 200.0 Pa). If the difference is smaller than the predetermined value S4, the judgment condition (5) is met and the process is exited.

If any of the judgment conditions (1) to (5) fails to be met in steps 833 to 837, the presence of a large hole is not determined and the process advances to step 839. The open absence flag is set to one and the process is exited.

FIG. 16 shows the second large hole judgment subroutine executed by the large hole judgment part 78 at step 850 in FIG. 14. This subroutine finally judges whether a large hole is present. At step 851, the process advances to step 852 only if the open presence flag is set to zero while the float valve activation flag is set to zero. That is, only if all the judgment conditions are met in the first large hole judgment in FIG. 15 and the pressure reducing processing time T4 corresponding to the judgment condition (6) is longer than a predetermined period of time S5 (for example, 5.5 seconds), the large hole presence flag is set to one, indicating that a large hole has been detected. In this embodiment, the presence of a large hole is judged only if all the judgment conditions (1) to (6) are met. In another embodiment, the large hole judgment may be made using any one or more of the judgment conditions (1) to (6).

At step 853, the status observed when the presence of a large hole was determined is stored in the RAM 93. Specifically, the difference between the tank pressure P4 measured when the pressure reducing process is completed and the tank pressure P5 measured immediately after the start of the leak checking process, a predetermined reference value for this difference (e.g. the above-mentioned predetermined value S2), and a code indicative of the presence of a large hole may be stored. Since the presence of a large hole has been determined, one is set in the reduced tank-pressure monitoring completion flag at step 854 to prohibit the following reduced tank-pressure monitoring during this driving cycle.

Vapor Checking Mode

Figure 17:
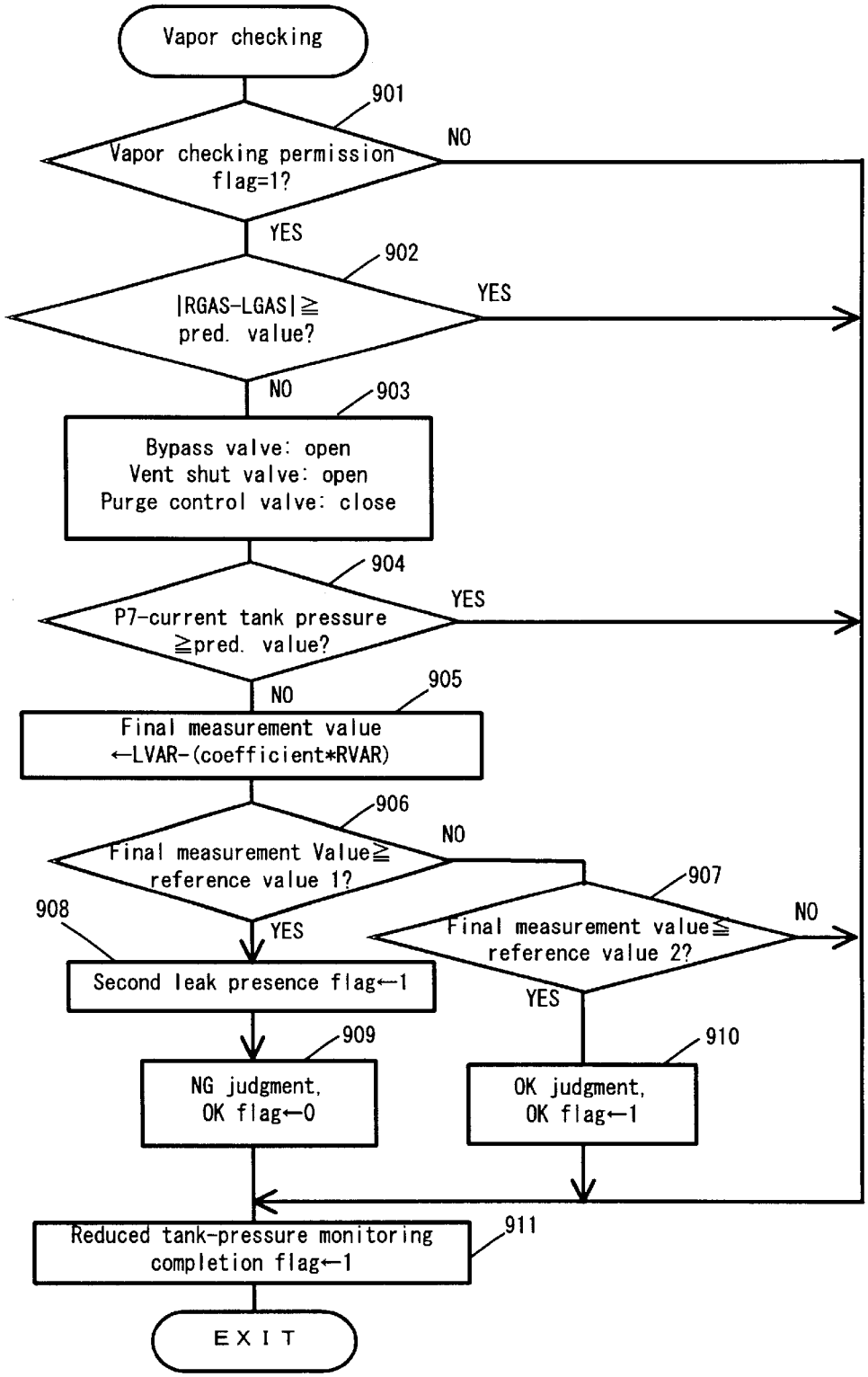
FIG. 17 is a flowchart illustrating a vapor checking process in accordance with one embodiment of the present invention.

FIG. 17 is a flow chart of a vapor checking process executed by the vapor checking part 66. If the vapor checking permission flag, which is set to one upon the completion of the leak checking process, has been set to one (901), the vapor checking process is started.

In step 902, a judgment is made as to whether or not the absolute value of the difference between the fuel consumption amount RGAS in the correction checking process and the fuel consumption amount LGAS in the leak checking process is equal to or greater than a predetermined value (e.g., 10 cc) If the absolute value of this difference is equal to or greater than this predetermined value, then it is judged that an accurate judgment cannot be made, since the operating states for the two modes differ greatly. Accordingly, the process proceeds to step 911, the reduced tank-pressure monitoring completion flag is set at one to prohibit the reduced tank-pressure monitoring for this driving cycle. In regard to the above-mentioned predetermined value, data indicating the effects of different driving states in the correction checking mode and leak checking mode on the detection of leakage caused by very small holes may be accumulated by experiment and simulation, and the above-mentioned predetermined value may be determined on the basis of the results obtained.

In step 902, if the absolute value of the difference between RGAS and LGAS is smaller than the value determined as described above, the process proceeds to step 903, in which the bypass valve 24 and vent shut valve 26 are opened, and the purge control valve is closed, so that the tank system is opened to the atmosphere. The process then proceeds to step 904, in which the current tank pressure and the tank pressure P7 measured upon the completion of the leak checking process, which was stored in step 811 of the leak check process (FIG. 14), are compared, and a judgment is made as to whether or not the tank pressure has dropped toward atmospheric pressure from a positive pressure.

If the tank pressure has dropped from a positive pressure toward atmospheric pressure, this indicates that large amounts of vapor were generated so that the tank pressure fluctuated to a positive pressure at the time of completion of the leak checking mode, thus making it impossible to make an accurate judgment. Accordingly, the process proceeds to step 911, the reduced tank-pressure monitoring completion flag is set at one to prohibit the monitoring. If the tank pressure has not dropped from a positive pressure to atmospheric pressure by an amount equal to or greater than the above-mentioned predetermined value, the process proceeds to step 905, and the final measurement value used to make a judgment is calculated using the following equation:

$$\text{Final measurement value} = LVAR - (\text{correction coefficient} \times RVAR) \quad \text{(Formula 4)}$$

Here, LVAR is the amount of pressure shift per unit time obtained in step 810 (FIG. 14) in the tank leak checking process, and RVAR is the amount of pressure shift per unit time obtained in step 607 (FIG. 11) in the correction checking process. The correction coefficient is a coefficient used to correct for different conditions for the pressure rise from atmospheric pressure in the correction checking mode and for the pressure rise from a negative pressure in the leak checking mode. For example, this coefficient is 1.5 to 2.0.

At steps 906 and 907, the second leak judgment is carried out. If the calculated final measurement value is larger than or equal to a reference value 1 (for example, 1066.6 Pa), the rise in pressure in the leak checking mode is assumed to be caused by leakage from the tank system. Abnormality is determined (NG judgment), that is, it is judged that there is leakage from the tank system, one is set in the second leak presence flag (908), and "zero" is set in an OK flag (909). If the calculated final measured value is smaller than the reference value 1, the process proceeds to step 907.

At step 907, if the calculated final measurement value is smaller than or equal to a reference value 2 (for example, 400.0 Pa), the rise in pressure in the leak checking mode is assumed to be caused by vapors generated in the tank. Consequently, it is judged that the tank system has no leakage and is normal (OK judgment), and one is set in the OK flag (910). If the final measured value is larger than the reference value 2, that is, larger than the reference value 2 and smaller than the reference value 1, it cannot be accurately judged whether there is leakage. Thus, the reduced tank-pressure monitoring completion flag is set to one to prohibit the monitoring (911).

Lighting Control

Figure 18:
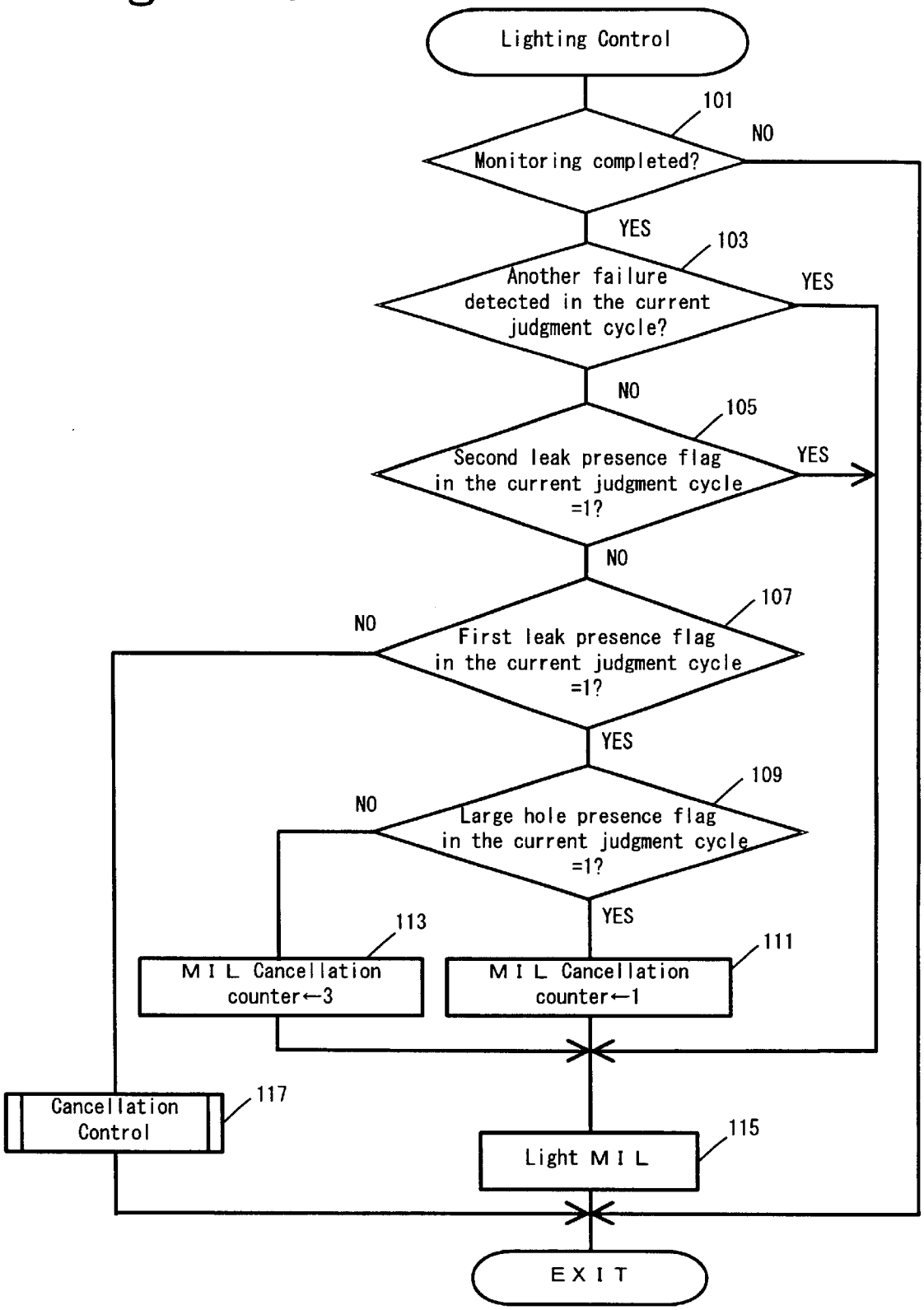
FIG. 18 is a flow chart illustrating an example of a lighting control process in accordance with one embodiment of the present invention.
Figure 19:
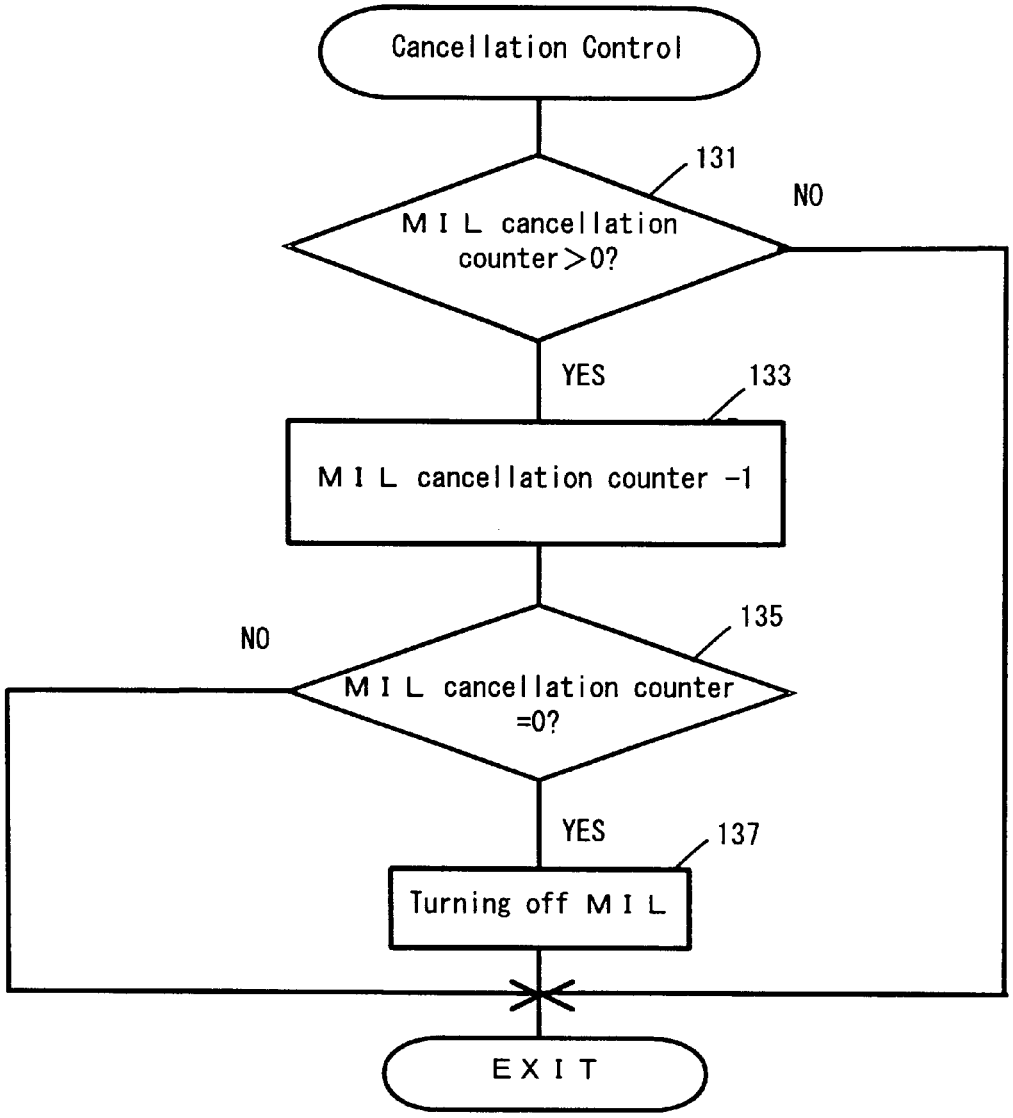
FIG. 19 is a flow chart illustrating a process for turning off the MIL in the lighting control in accordance with one embodiment of the present invention.

FIGS. 18 and 19 show flowcharts of lighting control executed by the MIL lighting controller 81 and correspond to the first example in FIG. 7(*a*).

The process of the lighting control in FIG. 18 is started when any of the first and second leak judgments and other failure diagnosis has been carried out and the corresponding monitoring completion flag has been set to one. When one of the monitoring operations has been completed (101), it is judged whether any of another failure, the first leak, and the second leak has been detected during the current driving cycle (103 to 107). If so, one is set in the lighting flag to light the MIL (115).

If another failure or the second leak has not been detected and the first leak presence flag has been set to one during the current driving cycle, that is, during the current judgment cycle (107), it is checked, before lighting the MIL, whether the large hole presence flag has been set to one during the current driving cycle (109).

If the large hole presence flag has been set to one, one is set in an MIL cancellation counter (111) and the MIL is lit (115). If the large hole presence flag has not been set to one, that is, only the first leak has been detected, three is set in the MIL cancellation counter (113) and the MIL is.lit (115).

The MIL cancellation counter is a down counter for judging whether to turn off the MIL; the MIL is turned off when the MIL cancellation counter reaches zero. In this embodiment, at steps 111 and 113, the MIL cancellation counter is set to different values depending on whether or not a large hole has been detected so that the MIL is turned off quickly only if leakage from a large hole has been eliminated whereas the MIL is not turned off in the case of another leakage or failure unless the diagnosis is judged to be erroneous.

At step 107, if the first leak presence flag does not show one during the current driving cycle, this means that no failure or leakage has been detected during the current driving cycle. Accordingly, the process proceeds to step 117 to execute a cancellation control routine.

FIG. 19 shows a flowchart of the cancellation control routine executed by step 117 in FIG. 18. It is checked at step 131 whether the MIL cancellation counter shows a value larger than zero. If the value is not larger than zero (that is, the MIL cancellation counter shows a value of zero), the MIL is not currently lighting, so that this process routine is exited. If the MIL cancellation counter shows a value larger than zero, the MIL is currently lighting, so that the subsequent steps are executed.

At step 133, the MIL cancellation counter is decremented by one. That is, when no failure or leakage has been detected during the current driving cycle, the MIL cancellation counter is decremented by one. As a result, when the MIL cancellation counter has reached zero at step 135, zero is set in the lighting flag to turn off the MIL (137). If the MIL cancellation counter shows a value other than zero, the process is continued.

As seen in FIG. 18, the MIL cancellation counter is set to one when the first leak and a large hole have been detected, and to three when only the first leak has been detected but not a large hole. Thus, when the first leak and a large hole were detected during the last driving cycle as in the example in FIG. 7(*a*), the MIL cancellation counter is set to one to light the MIL. Subsequently, if the first leak has not been detected during the current driving cycle, the MIL cancellation counter is set to zero to turn off the MIL. This is because it can be judged that the first leak detected during the last driving cycle was caused by a large hole and that the large hole has been eliminated during the current driving cycle.

On the other hand, if only the first leakage was detected but not a large hole during the last driving cycle, the MIL cancellation counter is set to three to light the MIL as shown in step 111 in FIG. 18. If the first leakage has not subsequently been detected during the current driving cycle, the MIL cancellation counter is decremented by one (133), but the MIL continues lighting (135) because the counter does not reach zero. Thus, only the MIL lighted due to leakage from a large hole can be turned off quickly.

If only the first leak has been detected and has not been caused by a large hole as described above, the MIL cancellation counter is set to three in step 113 in FIG. 18. If the first leak has not been detected during three consecutive driving cycles, this first leak detection is judged to be an erroneous diagnosis, thus the MIL being turned off. Such a diagnosis is similarly applicable to the second leak or other failures.

Figure 20:
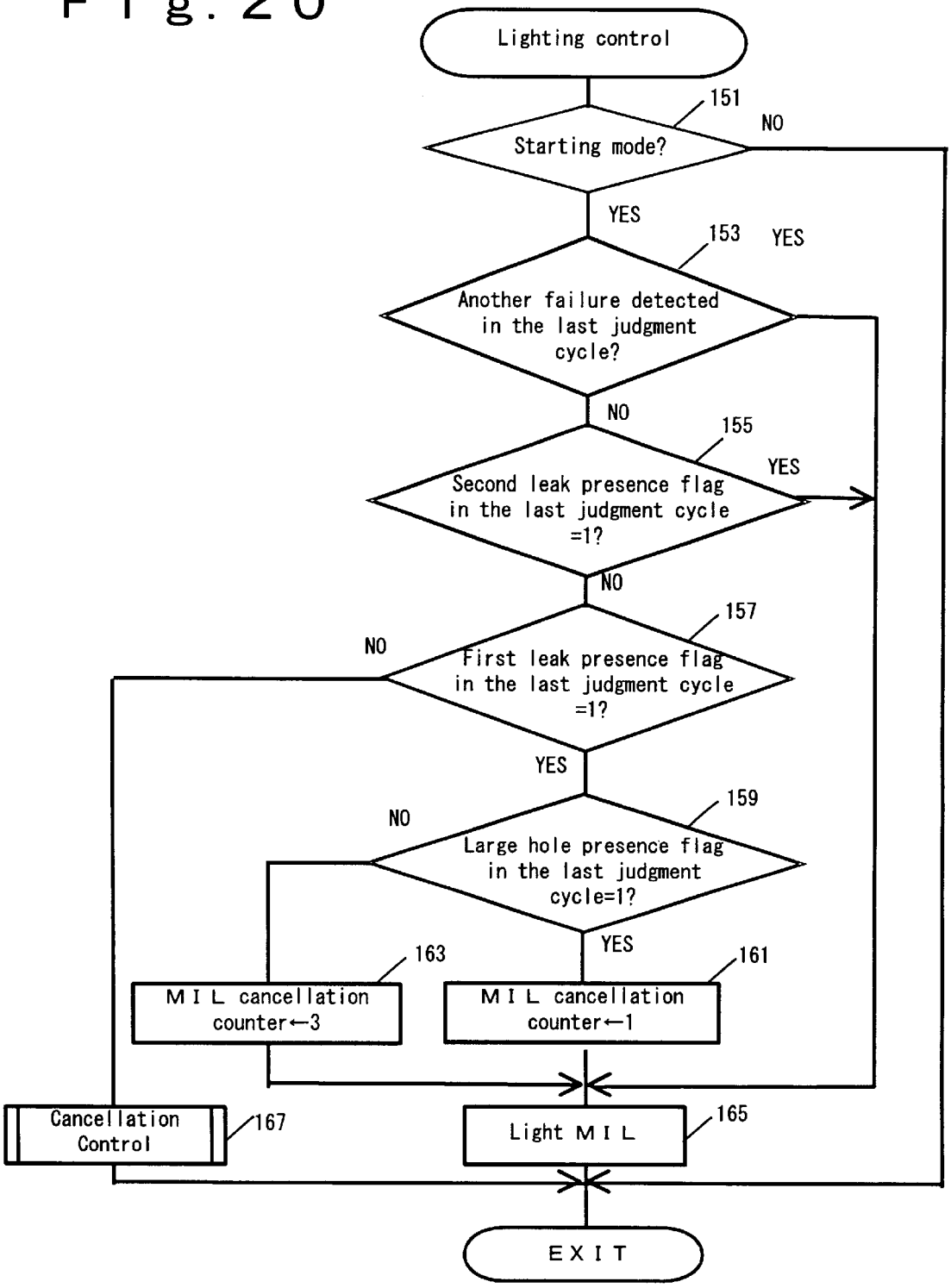
FIG. 20 is a flow chart illustrating an other example of the lighting control process in accordance with one embodiment of the present invention.

FIG. 20 shows a flowchart corresponding to the second example in FIG. 7(*b*) and shows how lighting of the MIL is controlled when a driving cycle is started. In addition to this lighting control, another lighting control such as that shown in FIG. 18 can be arbitrarily effected after the driving cycle has been started.

In contrast to FIG. 18, it is judged at step 151 whether the engine is in a starting mode. This judgment can be made based on the number of engine rotations, for example, from an NE sensor 16 (FIG. 1). If the engine is in the starting mode, the subsequent steps are executed in the similar way as shown in FIG. 18. That is, if it has been judged at steps 153 to 157 that any of another failure, the second leak, and the first leak was detected during the last driving cycle, the MIL is lit (165). If the first leak presence flag was set to one during the last driving cycle (157), it is further checked, before lighting the MIL, whether the large hole presence flag was set to one during the last driving cycle (159).

If the large hole presence flag has been set to one, one is set in an MIL cancellation counter (161). If the large hole presence flag has not been set to one, three is set in the MIL cancellation counter (163) and the MIL is lit (165). If it has been judged at step 157 that the first leak presence flag was not set to one during the last driving cycle, the process advances to step 167 to execute the cancellation control routine.

The cancellation control routine is the same as shown in FIG. 19. That is, if the MIL cancellation counter shows a value larger than zero, the MIL is lighting, so that the MIL cancellation counter is decremented by one. If the MIL cancellation counter shows a value of zero, the MIL is turned off. Thus, if it is judged at the start of a driving cycle that the MIL was lit due to leakage from a large hole during the driving cycle before last and that the large hole was eliminated during the last driving cycle, then the MIL can be turned off during the current driving cycle.

In another embodiment, instead of the warning lamp or along with the warning lamp, a speaker may be installed in a vehicle to issue a warning with voice or beep. In addition, a driver may be notified of the cancellation of the warning with voice or beep. In such cases, the controller converts the electrical signal indicating that there is leakage or another failure into voice signal, and then outputs it for the driver.

Although particular embodiments of the invention have been described in detail, it should be appreciated that the alternatives specifically mentioned above and many other modifications, variations, and adaptations may be made without departing from the scope of the invention as defined in the claims.

What is claimed is:

1. An evaporated fuel treatment apparatus for an internal combustion engine comprising:

an evaporated fuel discharge prevention system including a fuel tank, a canister having an opening to the atmosphere, a passage allowing the fuel tank to communicate with the canister, and a purging passage allowing the canister to communicate with the intake manifold of the engine;

a pressure sensor for detecting the pressure of the evaporated fuel discharge prevention system; and a controller coupled to the pressure sensor for judging the presence of a first leak in the evaporated fuel discharge prevention system if a change in the pressure from the pressure sensor is small, said controller checking a change in the pressure from said pressure sensor when said system is closed after placing said system under a negative pressure;

wherein said controller judges the presence of a large leak if the first leak is judged and the pressure increases instantaneously upon closing said system.

2. The apparatus of claim 1, further comprising a warning lamp lit by the controller when the first leak is judged; and wherein the controller turns off the warning lamp when the presence of the large leak is judged in a previous judgment cycle and any leak, including the first leak and the large leak, is not detected in the current cycle.

3. The apparatus of claim 1, further comprising a bypass valve that is configured to open the fuel tank to the atmosphere when in an opened state and to isolate the fuel tank from the atmosphere when in a closed state.

4. The apparatus of claim 3, further comprising a vent shut valve located between the bypass valve and the atmosphere and configured to open to the atmosphere when in an opened state and to close to the atmosphere when in a closed state.

5. The apparatus of claim 4, wherein the controller is configured to control operation of the bypass valve and the vent shut valve.

6. The apparatus of claim 5, further comprising a purging valve in the purging passage between the canister and the intake manifold and configured to open the purging passage when in an opened state and to close the purging passage when in a closed state.

7. The apparatus of claim 6, wherein the controller checks the pressure from the pressure sensor continuously and judges the presence of the first leak if the pressure concentrates in neighborhoods of the atmospheric pressure.

8. The apparatus of claim 7, wherein the controller judges the presence of the large leak if the difference between the pressure as detected when placing the system under a negative pressure and the pressure as detected immediately after the evaporated fuel discharge prevention system is closed is greater than a predetermined value.

9. The apparatus of claim 8, wherein the presence of the large leak is judged if one or more of the following conditions are met; the conditions including:

i) the difference, between the pressure as detected when the evaporated fuel discharge prevention system is opened to the atmosphere and the pressure as detected when the bypass valve is closed after said opening to the atmosphere, is smaller than a predetermined value;

ii) the difference, between the pressure as detected when the evaporated fuel discharge prevention system is opened to the atmosphere and the pressure as detected when the system is closed after placing the system under a negative pressure, is smaller than a predetermined value;

iii) the difference, between the pressure as detected immediately after the evaporated fuel discharge prevention system is closed and the pressure as detected a predetermined period of time after the system is closed, is smaller than a predetermined value; and iv) a period required for placing the evaporated fuel discharge system under a predetermined negative pressure is longer than a predetermined period.

10. The apparatus of claim 2, further comprising a speaker that notifies a driver of a warning with voice or beep when the first leak is judged.

11. A method for independently judging a large leak in an evaporated fuel discharge prevention system for an internal combustion engine, the system comprising a fuel tank, a canister having an opening to the atmosphere, a passage allowing the fuel tank to communicate with the canister, and a purging passage allowing the canister to communicate with the intake manifold of the engine, the method comprising:

monitoring the pressure of the evaporated fuel discharge prevention system;

judging the presence of a first leak in said system if a change in the pressure of the system is small;

checking a change in the pressure as detected when the system is closed after placing the system under a negative pressure; and judging the presence of the large leak in the system if the first leak is judged and the pressure increases instantaneously upon closing the system.

12. The method of claim 11, further comprising:

issuing a driver of a warning when the first leak is judged; and canceling said warning if the presence of the large leak is judged in a previous judgment cycle and then any leak, including the first leak and the large leak, is not detected in the current judgment cycle.

13. The method of claim 11, wherein the step of judging the presence of the first leak further comprises the steps of:

monitoring the pressure in the system continuously; and judging the presence of the first leak if the pressure concentrates in neighborhoods of the atmospheric pressure.

14. The method of claim 13, wherein the step of judging the presence of the large leak in the system further comprises the step of:

placing the system under a negative pressure;

closing the system after placing the system under a negative pressure;

determining the difference between the pressure as detected when placing the system under the negative pressure and the pressure as detected immediately after closing the system; and judging the large leak if the difference determined is greater than a predetermined value.

15. The method of claim 14, wherein the step of judging the presence of the large leak in the system requires that one or more of the following conditions are met, the conditions including:

i) the difference, between the pressure as detected when the evaporated fuel discharge prevention system is opened to the atmosphere and the pressure as detected when the bypass valve is closed after said opening to the atmosphere, is smaller than a predetermined value;

ii) the difference, between the pressure as detected when the evaporated fuel discharge prevention system is opened to the atmosphere and the pressure as detected when the system is closed after placing the system under a negative pressure is smaller than a predetermined value;

iii) the difference, between the pressure as detected immediately after the evaporated fuel discharge prevention system is closed and the pressure as detected a predetermined period of time after the system is closed, is smaller than a predetermined value; and iv) a period required for placing the evaporated fuel discharge system under a predetermined negative pressure is longer than a predetermined period.

16. The method of claim 12, wherein the step of issuing a driver of a warning when the first leak is judged comprises a step of notifying a driver of a warning with a lamp, voice or a beep.

17. An evaporated fuel treatment apparatus for an internal combustion engine comprising:

an evaporated fuel discharge prevention system including a fuel tank, canister having an opening to the atmosphere, a passage allowing the fuel tank to communicate with the canister, and a purging passage allowing the canister to communicate with the intake manifold of the engine;

a pressure sensor for detecting the pressure of the evaporated fuel discharge prevention system;

a first leak judgment means for judging the presence of a first leak in the evaporated fuel discharge prevention system if a change in the pressure from the pressure sensor is small;

a large leak judgment means for checking a change in the pressure from said pressure sensor when the system is closed after placing the system under a negative pressure, and judging the presence of a large leak if the first leak is judged and the pressure increases instantaneously upon closing said system.

18. The apparatus of claim 17, further comprising:

a warning means for issuing a warning when the first leak is judged, a warning canceling means for canceling said warning if the presence of the large leak is judged in a previous judgment cycle and then any leak, including the first leak and the large leak, is not detected in the current judgment cycle.

19. The apparatus of claim 17, wherein the first leak judgment means checks the pressure from the pressure sensor continuously, and judges the presence of the first leak if the pressure concentrates in neighborhoods of the atmospheric pressure.

20. The apparatus of claim 17, wherein the large leak judgment means judges the presence of the large leak if the difference between the pressure as detected when placing the system under a negative pressure and the pressure as detected immediately after the evaporated fuel discharge prevention system is closed is greater than a predetermined value.

* * * * *